US008833753B2

(12) United States Patent
Araishi

(10) Patent No.: US 8,833,753 B2
(45) Date of Patent: Sep. 16, 2014

(54) SHEET DETECTION DEVICE, AUTOMATIC DOCUMENT FEEDER AND IMAGE FORMING APPARATUS

(71) Applicant: KYOCERA Document Solutions Inc., Osaka (JP)

(72) Inventor: Kuniaki Araishi, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 13/855,899

(22) Filed: Apr. 3, 2013

(65) Prior Publication Data

US 2013/0264768 A1 Oct. 10, 2013

(30) Foreign Application Priority Data

Apr. 6, 2012 (JP) ..... 2012-087348

(51) Int. Cl.

| | |
|---|---|
| ***B65H 7/02*** | (2006.01) |
| ***B65H 5/00*** | (2006.01) |
| ***G03G 15/00*** | (2006.01) |
| ***G03G 21/16*** | (2006.01) |

(52) U.S. Cl.

CPC .. *B65H 5/00* (2013.01); *B65H 7/02* (2013.01); *G03G 15/607* (2013.01); *G03G 15/6529* (2013.01); *G03G 21/1638* (2013.01); *G03G 21/1695* (2013.01); *G03G 2215/00721* (2013.01)

USPC ..... 271/10.02; 271/10.03; 271/258.01; 271/265.01

(58) Field of Classification Search

CPC ..... B65H 2511/22; B65H 2511/514; B65H 2513/51; B65H 2513/53; B65H 7/02; B65H 2511/20; B65H 5/062; B65H 2701/1912; B65H 2701/1313; B65H 7/18; B65H 2511/51; B65H 7/14

USPC ..... 271/10.02, 10.03, 258.01, 265.01

See application file for complete search history.

(56) References Cited

U.S. PATENT DOCUMENTS

| | | | | |
|---|---|---|---|---|
| 2007/0253756 | A1 | 11/2007 | Uehara | |
| 2011/0091261 | A1 * | 4/2011 | Honma et al. | 400/611 |
| 2011/0109038 | A1 * | 5/2011 | Nishizawa et al. | 271/226 |
| 2011/0241280 | A1 * | 10/2011 | Hong et al. | 271/110 |
| 2011/0248439 | A1 * | 10/2011 | Oshima | 271/3.16 |
| 2013/0099441 | A1 * | 4/2013 | Kikuchi et al. | 271/10.13 |

FOREIGN PATENT DOCUMENTS

| | | |
|---|---|---|
| JP | 2009-151027 | 7/2009 |

* cited by examiner

*Primary Examiner* — David H Bollinger

(74) *Attorney, Agent, or Firm* — Gerald E. Hespos; Michael J. Porco; Matthew T. Hespos

(57) ABSTRACT

A sheet detection device includes a moving member and a support member. The moving member includes an interference part capable of interfering with a sheet that passes through a sheet transport path. The support member slidably supports the moving member. When a sheet passes through the sheet transport path in a forward direction, the sheet interferes with the interference part of the moving member in a protruding posture, and the moving member turns in a first direction along the forward direction in a state of maintaining the protruding posture. When a sheet once stopped on the sheet transport path is pulled out in a reverse direction with a predetermined pull-out force, the moving member turns in a second direction that is opposite to the first direction, and changes the posture from the protruding posture to a retreating posture against a biasing force of a first bias member.

17 Claims, 14 Drawing Sheets

SHEET DETECTION DEVICE, AUTOMATIC DOCUMENT FEEDER AND IMAGE FORMING APPARATUS

This application relates to and claims priority from Japanese Patent Application No. 2012-87348, filed on Apr. 6, 2012 in the Japan Patent Office, the entire disclosure of which is incorporated herein by reference.

BACKGROUND

The present disclosure relates to a sheet detection device for detecting a sheet that passes through a sheet transport path, and an automatic document feeder and an image forming apparatus to which the foregoing sheet detection device is applied.

An image forming apparatus which forms, on a printing sheet, an image based on a document image on a document sheet includes a device body for performing image forming, and an automatic document feeder and an image reading unit. The document sheet that is set on a document tray of the automatic document feeder is transported toward the image reading position of the image reading unit, and the document image thereof is optically read. The device body includes an image forming unit for forming an image based on the image data of the document image. The printing sheet is transported via the image forming unit, and the image is transferred thereto when the printing sheet passes through the image forming unit.

As described above, in an image forming apparatus, a sheet transport path for transporting the document sheet or the printing sheet is essential. Disposed on this sheet transport path is a sheet detection device for detecting the pass-through timing of the sheet or a sheet jam on the sheet transport path. A photo interrupter is generally used as the foregoing sheet detection device. A photo interrupter includes an actuator in which a part thereof protrudes to the sheet transport path and which turns upon interfering with the sheet that passes through the sheet transport path, and detects a sheet based on whether the light path between the light emitting unit and the light receiving unit is blocked by the actuator.

When the sheet is transported in the forward direction of the sheet transport path, since the actuator interferes with the sheet and turns in a direction of retreating from the sheet transport path, the sheet can pass through with almost no resistance. Nevertheless, when a sheet jam occurs and the sheet is pulled out from the sheet transport path in a direction that is opposite to the forward direction, there are cases where the actuator pinches the sheet. In the foregoing case, the sheet is easily damaged.

Conventionally, known is an image forming apparatus using an actuator capable of protruding and retreating a part thereof. With this image forming apparatus, the part of the actuator is withdrawn from the sheet transport path in a state of being retreated into the actuator body in conjunction with the opening of the outer cover so that the removal of the sheet is facilitated during the occurrence of a sheet jam. Nevertheless, with this device, a link mechanism for protruding and retreating a part of the actuator in conjunction with the opening and closing operation of the outer cover is required, and which induces the increase in the number of components and the complication of the structure.

An object of the present disclosure is to provide a sheet detection device which will not obstruct the pull-out of the sheet from the sheet transport path without having to increase the number of components, and an automatic document feeder and an image forming apparatus to which the foregoing sheet detection device is applied.

SUMMARY

The sheet detection device according to one aspect of the present disclosure is a sheet detection device for detecting a sheet which passes through a sheet transport path, and includes a moving member, a support member, a first bias member and a detection unit. The moving member includes an interference part capable of interfering with the sheet that passes through the sheet transport path. The support member slidably supports the moving member in a manner that allows a change in a posture thereof between a protruding posture in which the interference part protrudes to the sheet transport path and a retreating posture in which the interference part retreats from the sheet transport path relative to the protruding posture, includes a rotating axis extending in a direction that is orthogonal to the sliding direction, and rotates about the rotating axis to thereby cause the moving member to rotate about the rotating axis. The first bias member biases the moving member so that the moving member takes the protruding posture. The detection unit performs a detection operation of the sheet based on the rotation of the moving member.

When the sheet passes through the sheet transport path in a forward direction, the sheet interferes with the interference part of the moving member in the protruding posture, and the moving member turns in a first direction along the forward direction in a state of maintaining the protruding posture.

When the sheet once stopped on the sheet transport path is pulled out in a reverse direction, the sheet interferes with the interference part of the moving member in the protruding posture, and the moving member turns in a second direction that is opposite to the first direction, and changes the posture from the protruding posture to the retreating posture against a biasing force of the first bias member.

The automatic document feeder according to another aspect of the present disclosure includes a document sheet transport path for transporting a document sheet via an optical reading position, and a sheet detection device which is disposed with respect to the document sheet transport path and which detects the document sheet that passes through the document sheet transport path. This sheet detection device includes the configuration of the foregoing sheet detection device.

The image forming apparatus according to yet another aspect of the present disclosure includes an image forming unit which performs image forming processing to a printing sheet, a printing sheet transport path for transporting the printing sheet via the image forming unit, and a sheet detection device which is disposed with respect to the printing sheet transport path and which detects the printing sheet that passes through the printing sheet transport path. This sheet detection device includes the configuration of the foregoing sheet detection device.

DETAILED DESCRIPTION

Figure 1:
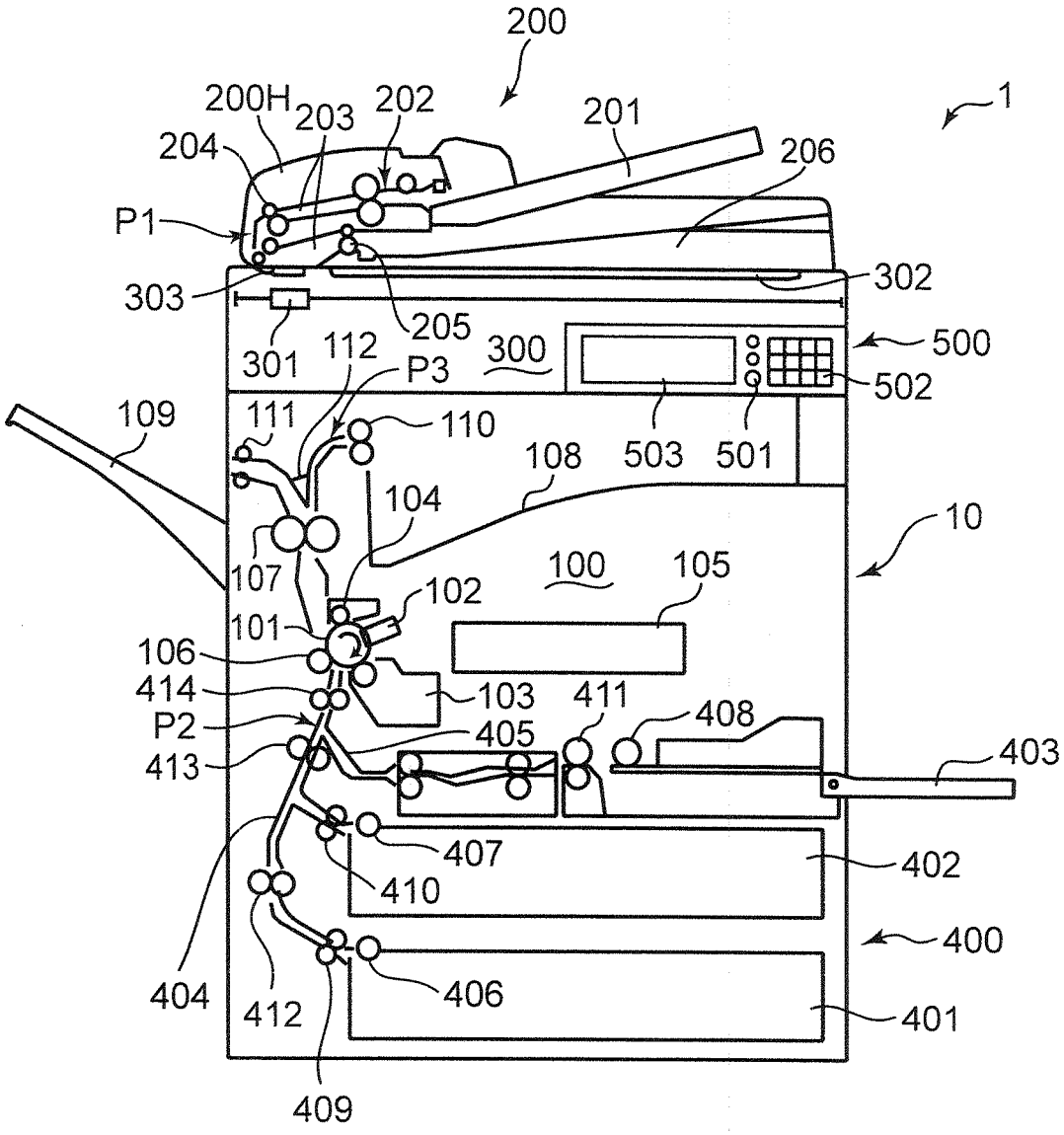
FIG. 1 is a schematic cross section of the copying machine as an example of the image forming apparatus according to the present disclosure.

Embodiments of the present disclosure are now explained with reference to the drawings. An automatic document feeder and an image forming apparatus to which the sheet detection device according to the present disclosure can be suitably applied are foremost explained. FIG. 1 is a cross section schematically showing the internal configuration of the copying machine 1 as one example of the image forming apparatus. The copying machine 1 includes a body housing 10, an image forming unit 100 for performing image forming processing to the printing sheets housed in the body housing 10, an automatic document feeder (ADF) 200 mounted on the top face of the body housing 10, a document reading unit 300 housed at the upper part of the body housing 10, a paper feeding unit 400 at the lower part of the body housing 10, and an operation display unit 500 installed at the upper front part of the body housing 10.

The document reading unit 300 optically reads a document sheet to be copied, and generates image data corresponding to the document sheet. The document reading unit 300 includes a moving carriage 301 on which a light source and a mirror are mounted, a first contact glass 302 and a second contact glass 303 fitted on the top face of the body housing 10, an imaging element (not shown) into which reflected light of light that was irradiated from the light source toward the document sheet enters, and an optical system (not shown) for causing the imaging element to image the reflected light. The document reading unit 300 acquires the image data of the document sheet mounted on the first contact glass 302 or the document sheet that is transported by the ADF 200 so as to come into contact with the second contact glass 303, and outputs the acquired image data to a control unit 20 described later.

The ADF 200 automatically feeds the document sheet to the document reading unit 300 (optical reading position where the second contact glass 303 is disposed). The ADF 200 includes a document tray 201 on which the document sheet is mounted, a delivery drive unit 202 including a delivery roller or the like and which feeds the document sheet from the document tray 201, a document sheet transport path 203 (sheet transport path) which extends from the downstream side of the delivery drive unit 202 via the optical reading position, a transport roller 204 which transports the document sheet on the document sheet transport path 203, an ejecting roller 205 which ejects the document sheet transported by the transport roller 204, and a document ejecting tray 206 for loading the document sheets ejected from the ejecting roller 205.

The ADF 200 automatically sends, one sheet at a time, the document sheets loaded on the document tray 201 to the document sheet transport path 203 according to the input of instructions for starting the copy process or the like, transports such document sheet while causing it to come into contact with the second contact glass 303, and thereafter ejects the document sheet onto the document ejecting tray 206. The document sheet transport path 203 is a transport path which extends substantially in the horizontal direction from the downstream side of the delivery drive unit 202, curves downward, and thereafter curves further in a U-shape up to the ejecting roller 205 via the disposed position of the second contact glass 303. When a document sheet becomes jammed on the document sheet transport path 203, the user can eliminate the jam by opening an upper cover 200H of the ADF 200, and pulling out the jammed document sheet in a direction that is opposite to the transport direction (forward direction). Note that the bottom face of the upper cover 200H configures the upper transport guide face of the document sheet transport path 203.

The ADF 200 is turnably coupled with the top face of the body housing 10 at the rear side thereof. When the user is to manually place the document sheet to be read, the user releases the first contact glass 302 by raising the front part of the ADF 200. In addition, the user mounts the document to be read, such as a book in an open state, on the top face of the first contact glass 302, and causes the document reading unit 300 to execute the reading operation.

The paper feeding unit 400 feeds the printing sheets to the image forming unit 100. The paper feeding unit 400 includes feeding cassettes 401, 402 for housing sheets (recording paper) of various sizes, and a manual paper tray 403 configured to be openable and closable at one side part of the body housing 10. Moreover, the paper feeding unit 400 includes a first sheet transport path 404 (printing sheet transport path) for transporting the printing sheets from the feeding cassettes 401, 402 to the image forming unit 100, and a second sheet transport path 405 (printing sheet transport path) for transporting the printing sheets from the manual paper tray 403 to the image forming unit 100. The first sheet transport path 404 is a sheet transport path that extends in the up-down direction up to the ejecting rollers 110, 111 described later via the image forming unit 100. The second sheet transport path 405 merges with the first sheet transport path 404 at the upstream side of the image forming unit 100.

In correspondence with the feeding cassettes 401, 402 and the manual paper tray 403, provided are pickup rollers 406, 407, 408 for extracting the sheets, and paper feed rollers 409, 410, 411 for feeding the sheets, one sheet at a time, to the respective transport paths. The first sheet transport path 404 is provided with transport rollers 412, 413 for transporting the sheets, and a resist roller 414 for causing the sheet to once stop at an upstream position of the image forming unit 100 and performing skew adjustment thereto, and delivering the sheet to the image forming unit 100 at a predetermined timing.

The image forming unit 100 transfers (prints) a predetermined image onto the sheet that was transported from the paper feeding unit 400. The image forming unit 100 includes a photoreceptor drum 101 that is supported rotatably in the arrow direction shown in the diagram, a charging unit 102, a developing unit 103, a cleaning unit 104, a laser scanning unit 105 and a transfer roller 106 disposed around the photoreceptor drum 101, and a fixing unit 107 disposed on the downstream side of the transfer roller 106.

The photoreceptor drum 101 carries, on its peripheral surface, an electrostatic latent image and a toner image as an actualization thereof. The charging unit 102 uniformly charges the surface of the photoreceptor drum 101 with a predetermined potential. The laser scanning unit 105 causes the surface of the photoreceptor drum 101 to be irradiated with a laser beam based on the image data that is sent from an image storage unit 30 or the like described later. An electrostatic latent image is formed on the peripheral surface of the photoreceptor drum 101 based on the foregoing irradiation. The developing unit 103 actualizes the image (document image) by attaching a toner to the electrostatic latent image. The transfer roller 106 forms a transfer nip part with the photoreceptor drum 101 and is given a transfer bias, and transfers the toner image on the photoreceptor drum 101 onto the sheet that passes through the transfer nip part. A cleaning unit 104 cleans the toner remaining on the surface of the photoreceptor drum 101 after the transfer of the image to the sheet is complete.

A fixing unit 107 fixes the toner image that was transferred to the sheet. The fixing unit 107 includes a heat roller and a pressure roller, melts the toner on the sheet with the heat of from the heat roller, applied pressure thereto with the pressure roller, and thereby fixes the toner on the sheet.

An internal ejecting tray 108 and an external ejecting tray 109 are provided to the upper part and the side surface of the body housing 10. The sheets that were subject to the fixation processing by the fixing unit 107 are respectively ejected to the internal ejecting tray 108 and the external ejecting tray 109 by the ejecting rollers 110, 111. Note that the transport direction of the sheets can be switched between the ejecting roller 110 side and the ejecting roller 111 side by an ejecting branch guide 112.

An operation display unit 500 receives the input of instructions to the copying machine 1 from a user. The operation display unit 500 includes a start key 501 for the user to input a printing execution command, a numerical keyboard 502 for inputting the number of copies to be printed or the like, and a touch panel 503 which display operation guide information for inputting the setting of various copy operations, as well as displays the various operation buttons and the like.

Figure 2:
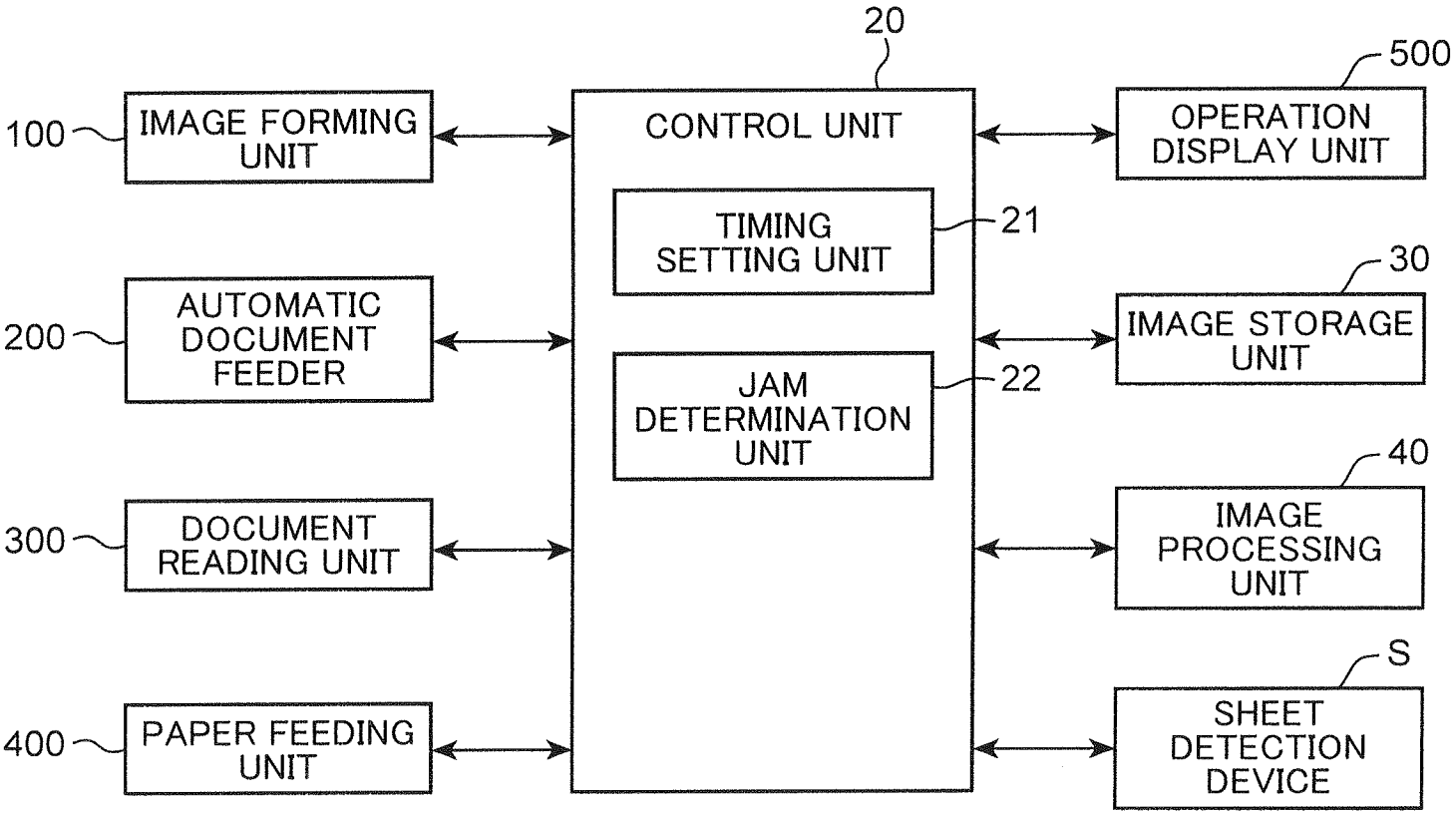
FIG. 2 is a block diagram schematically showing the electrical configuration of the foregoing copying machine.

FIG. 2 is a block diagram schematically showing the electrical configuration of the copying machine 1 shown in FIG. 1. The copying machine 1 includes a control unit 20 which governs the operational control of the overall device. The control unit 20 is a microcomputer which includes a read only memory (ROM) for storing control programs of the copying machine 1, a random access memory (RAM) for temporarily storing data, and reads and executes the foregoing control programs and the like from the ROM, and performs the control of the overall device according to predetermined command information input using the operation display unit 500 or the like, and the detection signal from the various sensor provided to the various locations in the device. In addition to the foregoing image forming unit 100, ADF 200, document reading unit 300, paper feeding unit 400 and operation display unit 500, connected to this control unit 20 are an image storage unit 30, an image processing unit 40 and a sheet detection device S.

The image storage unit 30 is a memory for temporarily storing the image data of documents that were read by the document reading unit 300, and the image data that is sent from an external device via a network I/F or the like not shown.

The image processing unit 40 performs various types of image processing to the foregoing image data such as gamma processing and zoom or reduced scale processing. With the image processing unit 40, for example, the analog data of the document sheet obtained by reading the document sheet with the document reading unit 300 is subject to A/D conversions, and the various types of image processing described above are performed using the digital image data.

The sheet detection device S is disposed at the appropriate locations on the document sheet transport path 203 in the ADF 200, and on the first and second sheet transport paths 404, 405 in the body housing 10, and detect the sheets that pass through the sheet transport paths 203, 404, 405. In other words, the sheet detection device S detects that a sheet has passed through its installation site or that the sheet is remaining in its installation site. While described in detail later, the sheet detection device S is a photo interrupter-type sensor device including an actuator which partially protrudes to the sheet transport paths 203, 404, 405 and turns upon interfering with the sheet that passes through the sheet transport paths, and a light emitting unit and a light receiving unit. The sheet detection signals from the sheet detection device S are sent to the control unit 20.

The sheet detection device S are disposed on the sheet transport paths 203, 404, 405 at locations that are appropriate for detecting the pass-through timing of the sheets or the detecting a sheet jam. For example, positions P1, P2, P3 and the like shown in FIG. 1 are the positions of installing the sheet detection device S. The position P1 is a position curved in a U-shape on the document sheet transport path 203. The position P2 is a position that is slightly more upstream than the disposed position of the resist roller 414 on the first sheet transport path 404. The position P3 is a position that is slightly more upstream than the disposed position of the ejecting roller 110 on the first sheet transport path 404. Needless to say, the sheet detection device S may also be installed at other positions.

In addition to the function part that controls the operation of the respective parts of the copying machine 1, the control unit 20 includes a timing setting unit 21 and a jam determination unit 22 related to the sheet detection operation of the sheet detection device S. The timing setting unit 21 sets the drive start/stop timing of the image forming unit 100 and the various rollers and the like based on the sheet pass-through detection result of the sheet detection device S. The jam determination unit 22 determines that a sheet jam has occurred when the sheet detection device S continues to output a signal of "sheet exists" for a predetermined time or longer, and causes the copying machine 1 to execute a predetermined warning operation.

Figure 3:
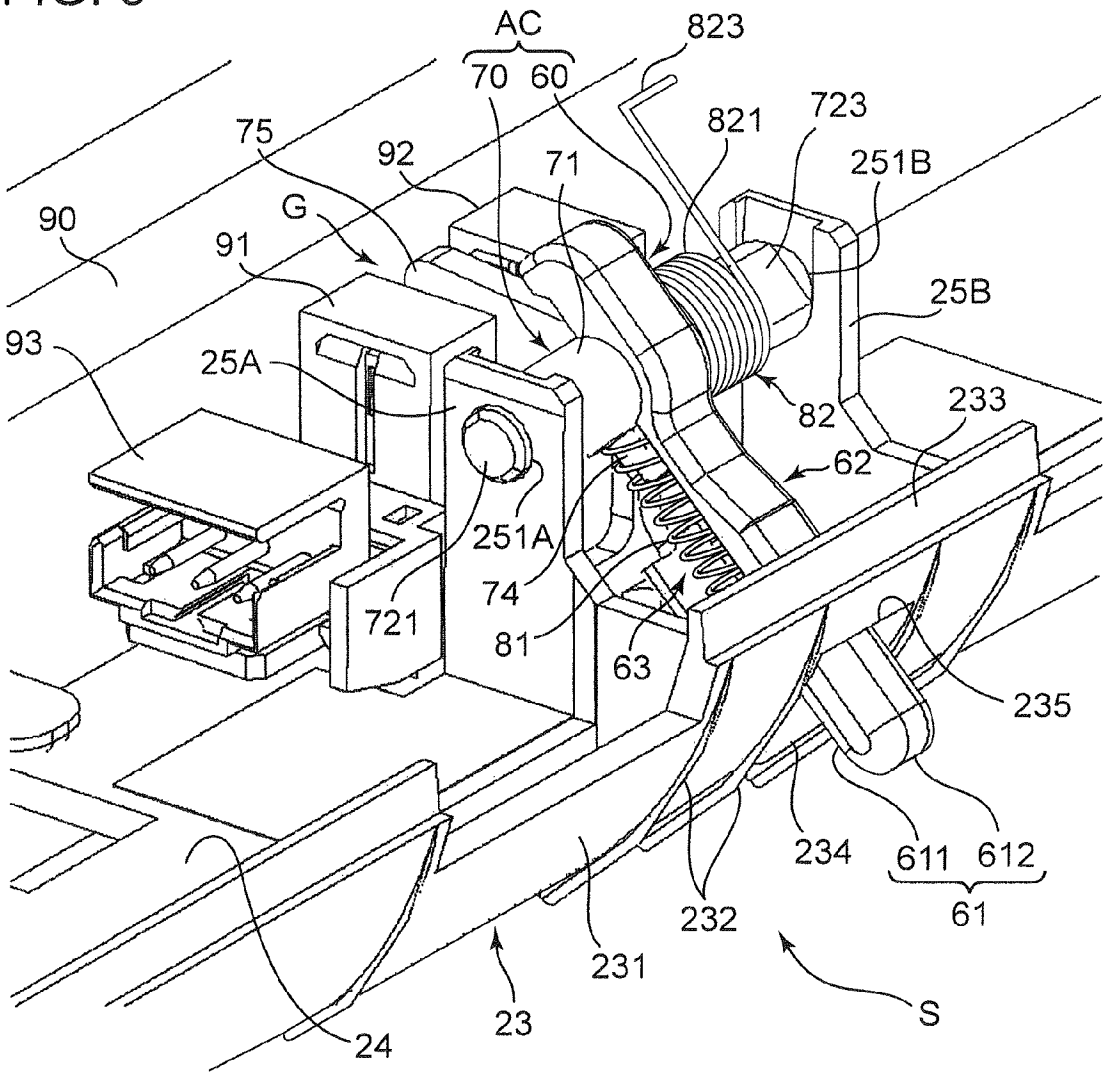
FIG. 3 is a perspective view of the sheet detection device.
Figure 4:
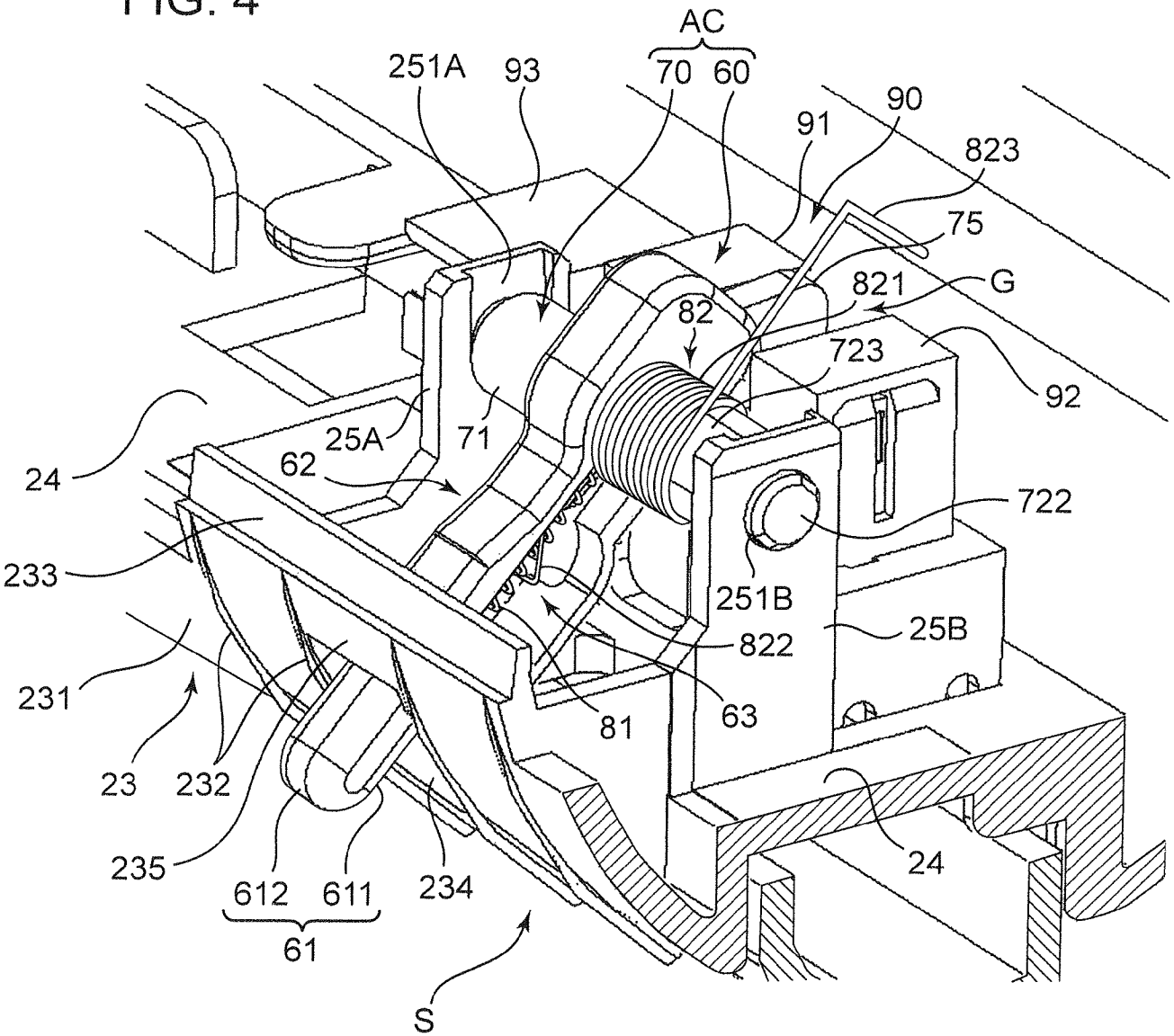
FIG. 4 is a perspective view of the sheet detection device from a different perspective direction than FIG. 3.
Figure 5:
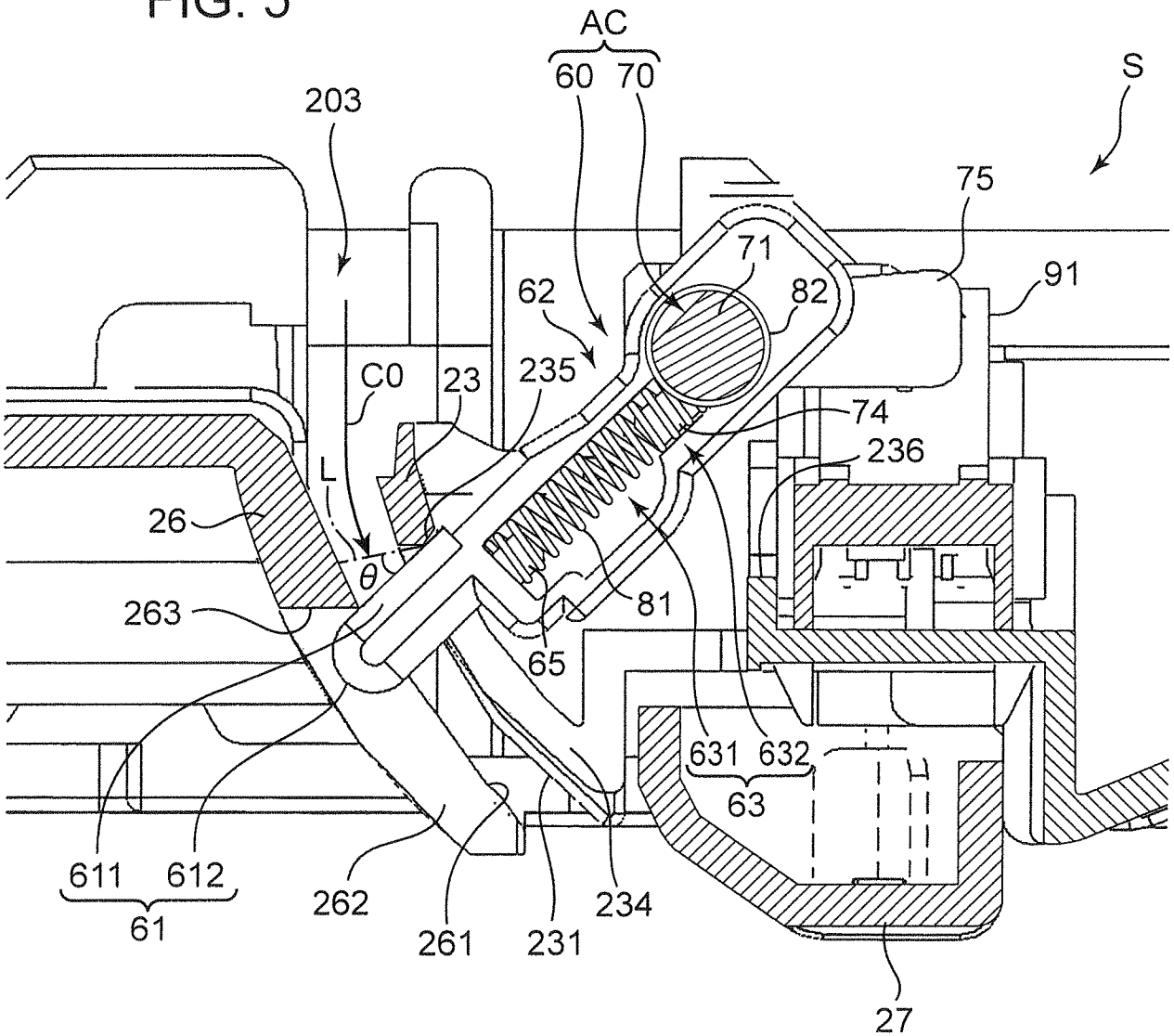
FIG. 5 is a cross section of the sheet detection device.

The sheet detection device S is now explained in detail. FIG. 3 and FIG. 4 are perspective views of the sheet detection device S, and are diagrams with mutually different perspective directions. FIG. 5 is a cross section of the sheet detection device S. In this embodiment, shown is a case where the sheet detection device S is applied to the document sheet transport path 203 (foregoing position P1) of the ADF 200.

A part of the transport path of the document sheet transport path 203 that is curved in a U-shape is formed, as shown in FIG. 5, from an inner guide member 23 curved at a predetermined curvature, and an outer guide member 26 placed opposite to the inner guide member 23 at a predetermined gap. The inner guide member 23 and the outer guide member 26 are guide members for forming the sheet transport path immediately before the optical reading position. In other words, the inner guide member 23 and the outer guide member 26 are disposed on the immediate upstream side of the facing member 27 which faces the second contact glass 303, and, upon viewing FIG. 5, forms a curved transport path in which the document sheet transport direction is changed approximately 90 degrees from the downward direction to the rightward direction.

The inner guide member 23 includes an inner guide face 231 that is moderately curved in a convex shape, a plurality of guide ribs 232 provided on the inner guide face 231 in a protruding manner and which extends in the document sheet transport direction, and a center guide part 233 positioned at the substantial center part of the inner guide face 231 in the width direction that is orthogonal to the sheet transport direction and which becomes the assembly position of the sheet detection device S. The center guide part 233 is provided with an inner slit 234 for causing a part (interference part 61) of the sheet detection device S to protrude. Moreover, a horizontal support plate 24 for supporting the sheet detection device S is connected to the rear face side of the inner guide face 231.

The outer guide member 26 includes an outer guide face 261 that is moderately curved in a concave shape, a plurality of guide ribs (not shown) provided on the outer guide face 261 in a protruding manner, and an outer slit 262 provided to the outer guide face 261 at a position facing the inner slit 234.

The sheet detection device S includes an actuator AC which turns upon interfering with the document sheet that passes through the document sheet transport path 203, and a detection unit 90 which performs the detection operation of the document sheet based on the turn of the actuator AC. This embodiment is unique in that the actuator AC is divided into a moving member 60, and a support member 70 which slidably supports the moving member 60. A compression coil spring 81 (first bias member) is interposed between the moving member 60 and the support member 70, and a torsion coil spring 82 (second bias member) is inserted into the support member 70.

The outline of the configuration and operation of the sheet detection device S is foremost explained. The moving member includes an interference part 61 capable of interfering with the sheet that passes through the document sheet transport path 203. The support member 70 slidably supports the moving member 60 in a manner that allows a change in a posture thereof between a protruding posture in which the interference part 61 protrudes to the document sheet transport path 203 and a retreating posture in which the interference part 61 retreats from the document sheet transport path 203 relative to the protruding posture. Moreover, the support member 70 rotates about the rotating axis extending in a direction that is orthogonal to the sliding direction, and the moving member 60 also rotates about the rotating axis based on the foregoing rotation. In other words, while the moving member 60 and the support member 70 turn integrally as the actuator AC, the moving member 60 is slidably supported by the support member 70 so that it can retreat from the sheet transport path 203. A light shielding member 75 is integrally mounted on the support member 70. The detection unit 90 includes a light emitting unit 91 and a light receiving unit 92 which are disposed with a gap G therebetween. The light shielding member 75 can enter into and withdraw from the gap G, and performs such entrance and withdrawal based on the rotating angle of the actuator AC.

Figure 6:
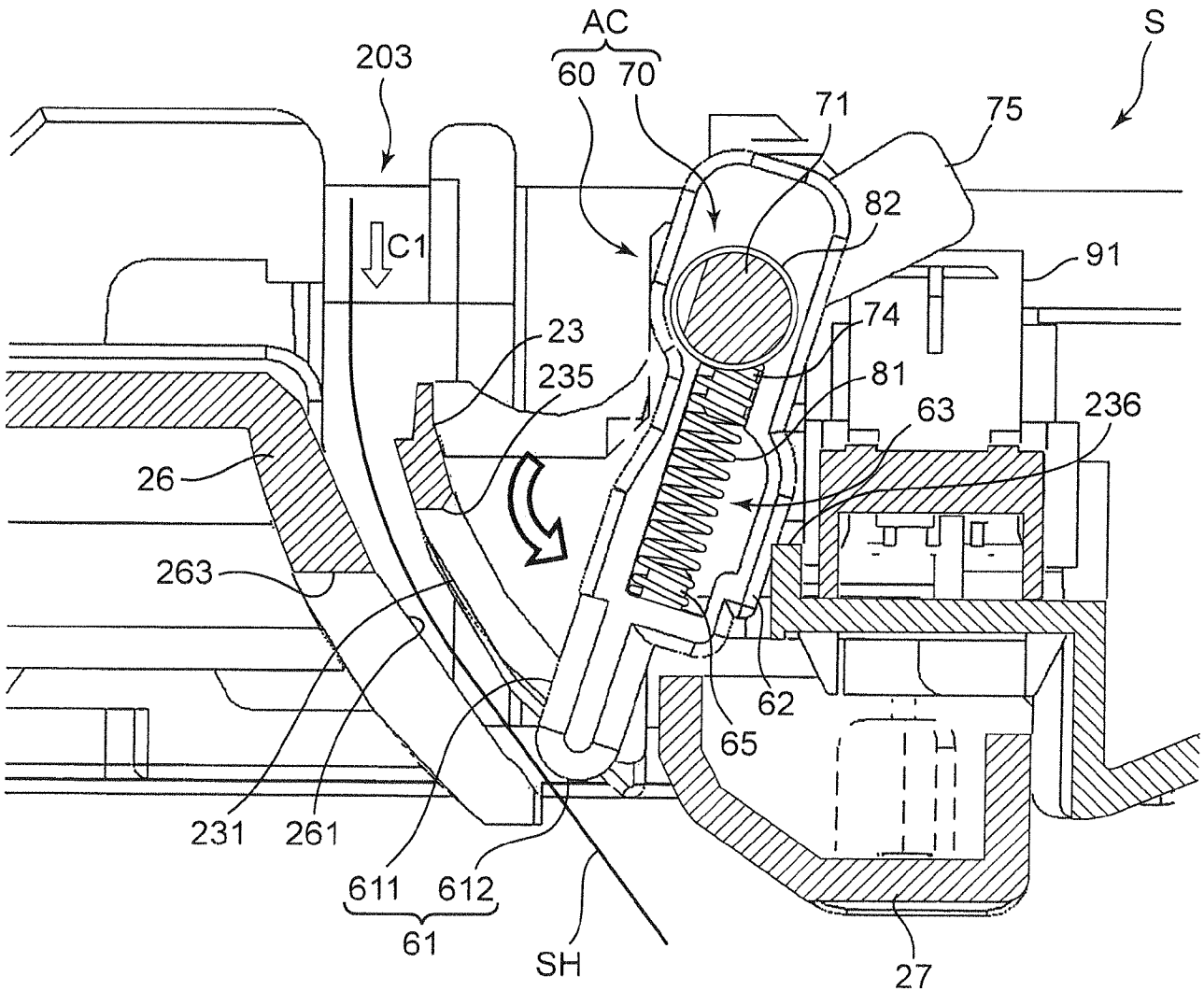
FIG. 6 is a cross section of the sheet detection device, and shows a state that the actuator is detecting a sheet.
Figure 7:
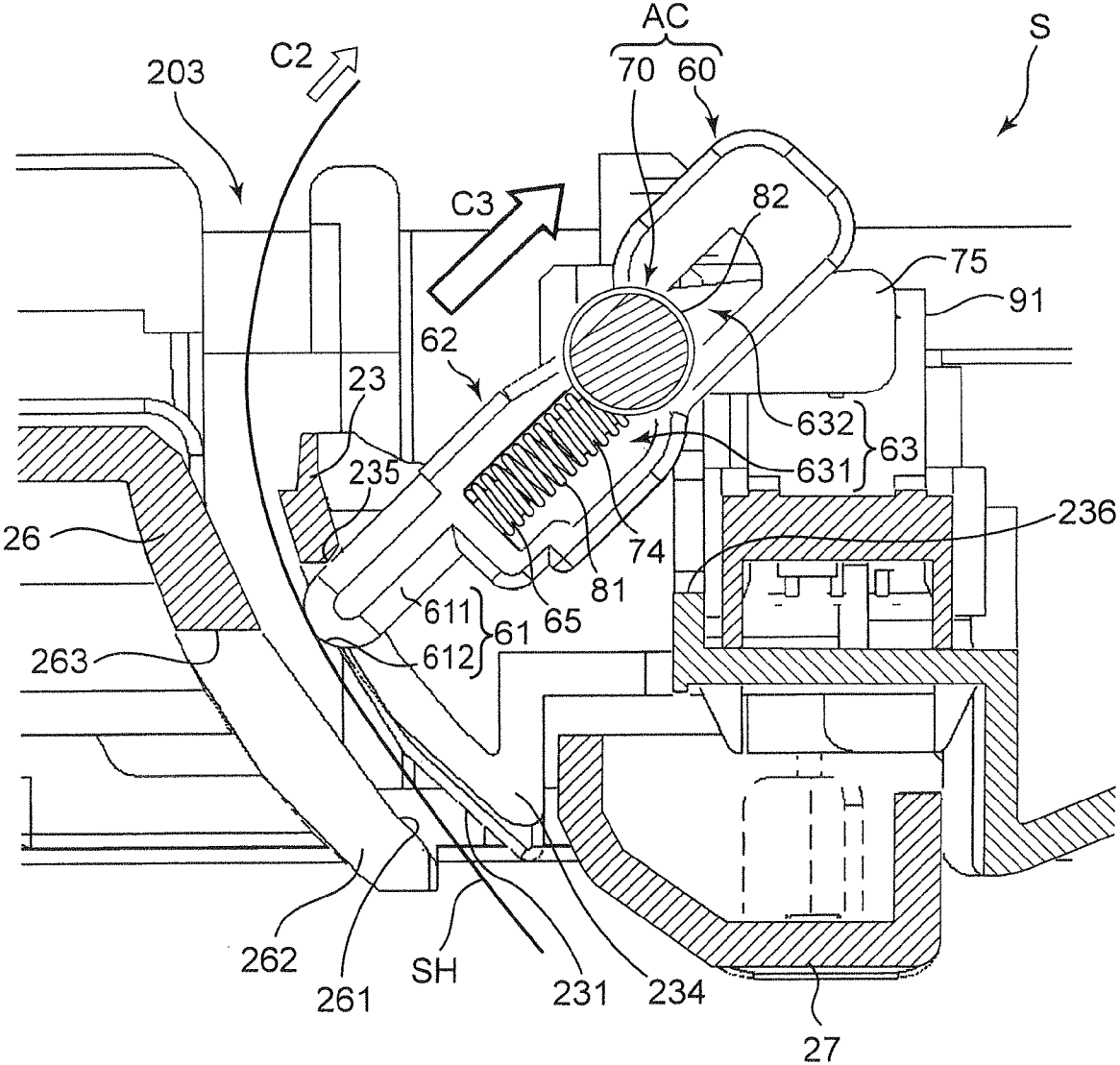
FIG. 7 is a cross section of the sheet detection device, and shows a state where the sheet is being pulled out in the reverse direction.

FIG. 5 to FIG. 7 are cross sections of the sheet detection device S. FIG. 5 shows a state where the actuator AC is in the home position. The moving member 60 is taking on a protruding posture, and the interference part 61 is protruding to the document sheet transport path 203. As shown in FIG. 6, when the document sheet passes through the document sheet transport path 203 in a forward direction (arrow C1 in the diagram), the sheet interferes with the interference part 61 of the moving member 60 in a protruding posture, and the moving member 60 turns in a counterclockwise direction (first direction) along the forward direction C1 in a state of maintaining the protruding posture.

Meanwhile, as shown in FIG. 7, when the document sheet once stopped on the document sheet transport path 203 due to the occurrence of a sheet jam or the like is pulled out in a reverse direction (arrow C2 in the diagram) with a predetermined pull-out force, the moving member 60 turns in a clockwise direction (second direction) from the state shown in FIG. 6. In addition, the moving member 60 changes the posture from the protruding posture to the retreating posture against the biasing force of the compression coil spring 81. Accordingly, the user can smoothly remove the once-stopped document sheet without being obstructed by the actuator AC. Note that the retreating posture includes, in addition to the mode of complete withdrawal from the document sheet transport path 203, the mode of protruding to the document sheet transport path 203 in a state of ensuring the path of the document sheet as a result of retreating more than the protruding posture (FIG. 7 shows an example where the interference part 61 is slightly protruding to the document sheet transport path 203).

Figure 8A:
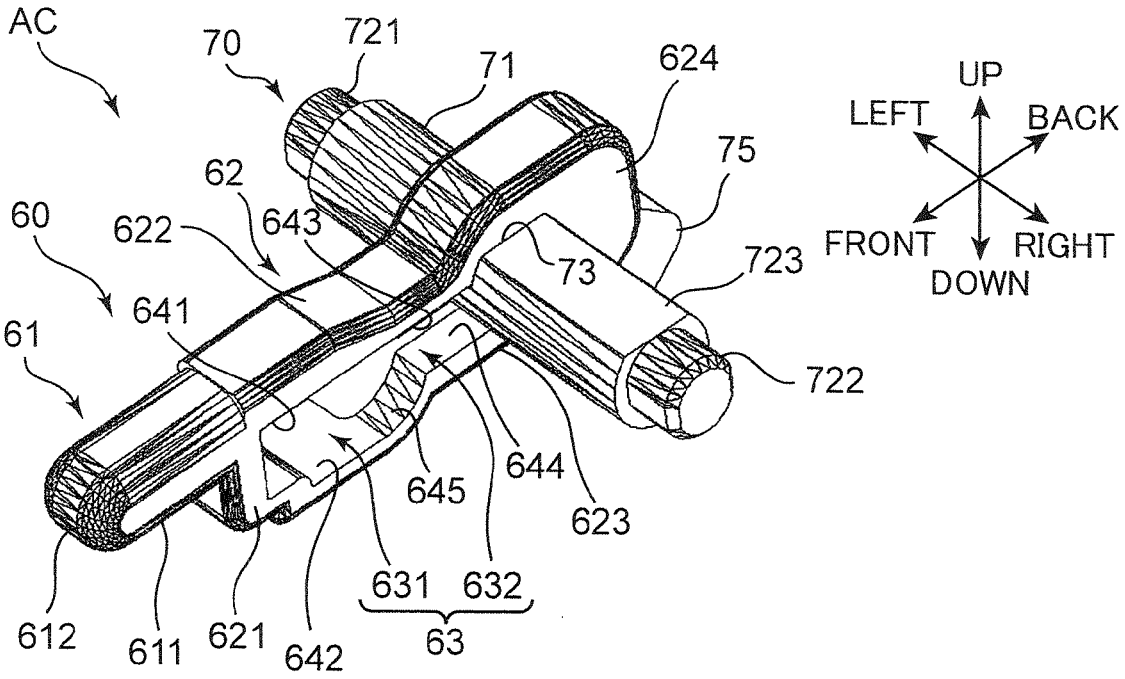
FIGS. 8A and 8B are perspective views of the actuator, and show a state where the moving member corresponds to a protruding posture.
Figure 8B:
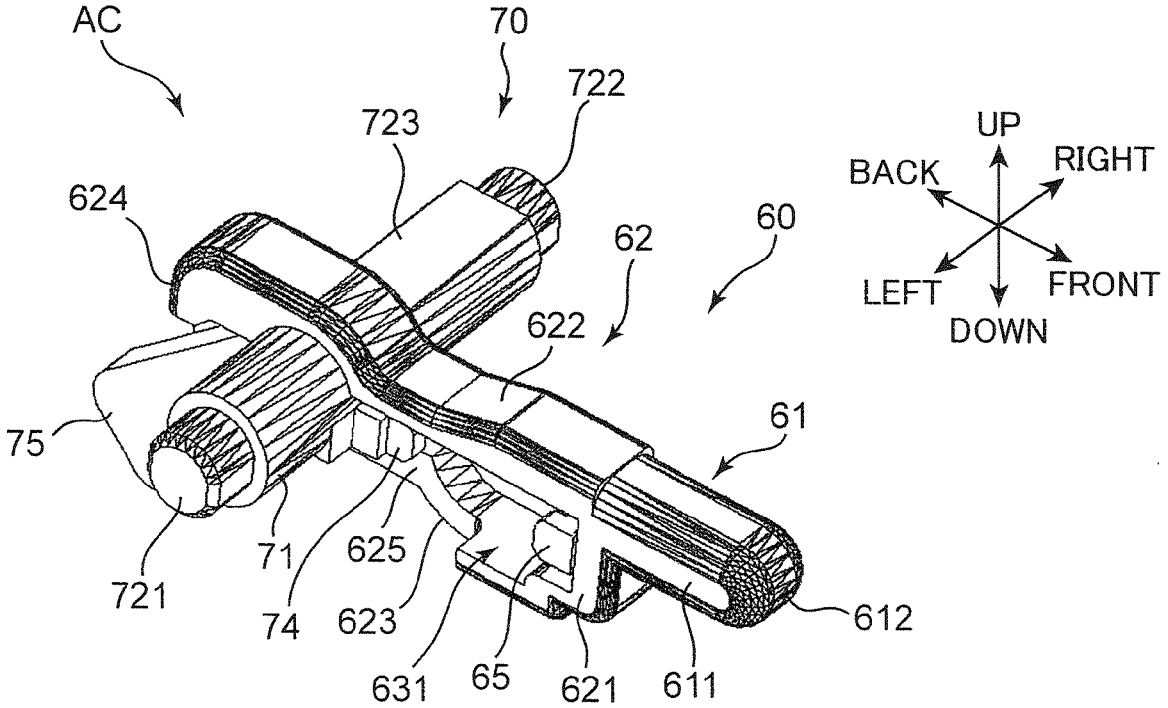
Figure 9A:
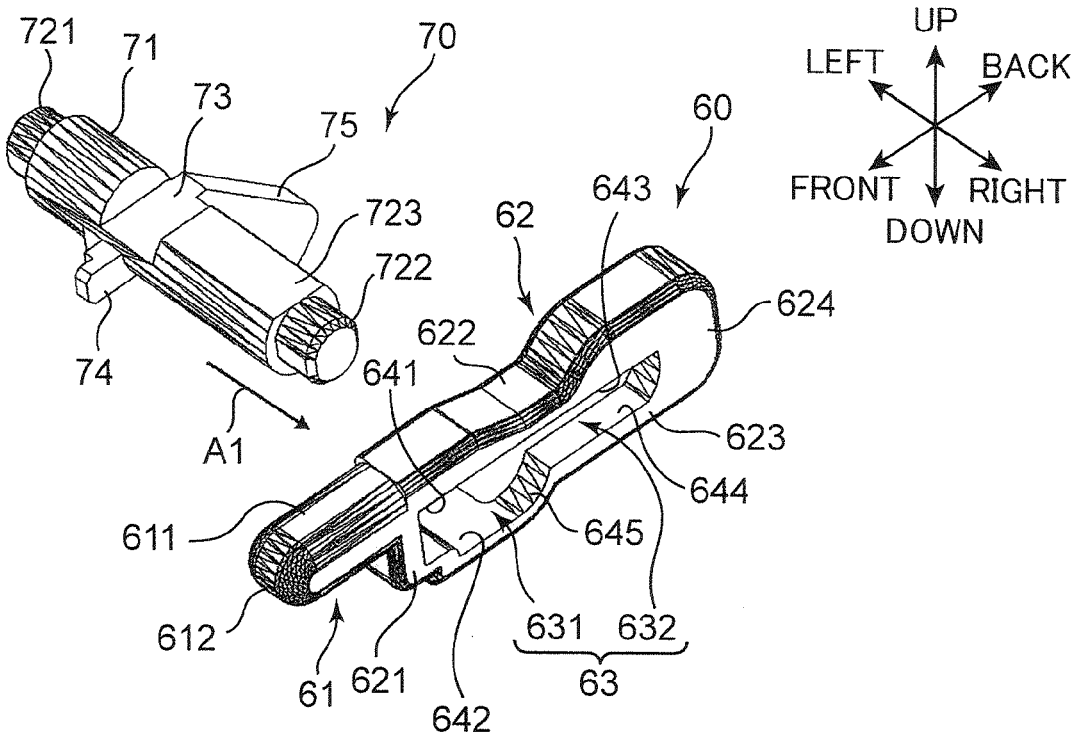
FIGS. 9A and 9B are exploded perspective views of the actuator.
Figure 9B:
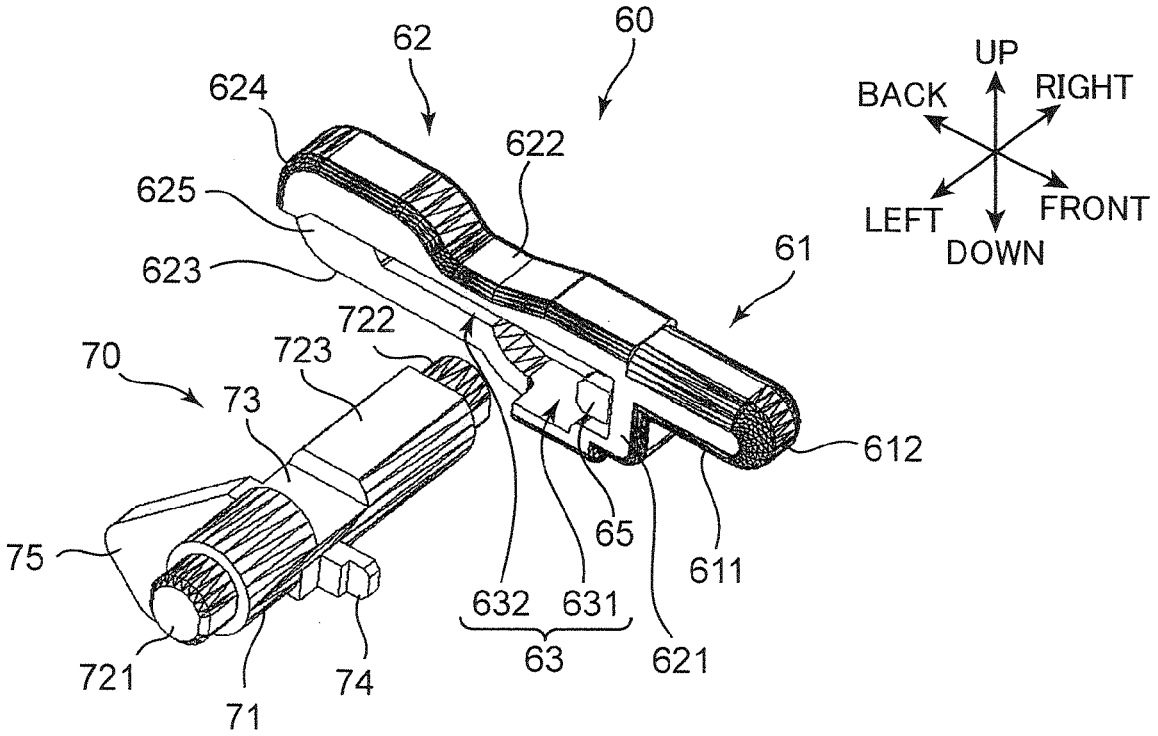

The configuration and operation of the respective components of the sheet detection device S are now explained in detail with reference to FIG. 8A to FIG. 12B, in addition to FIG. 3 to FIG. 7 described above. FIGS. 8A and 8B are perspective views of the actuator AC with different perspective directions, and are diagrams showing a state where the moving member 60 corresponds to the protruding posture. FIGS. 9A and 9B are exploded perspective views of the actuator AC with different perspective directions. FIGS. 10A and 10B, FIGS. 11A and 11B, and FIGS. 12A and 12B are perspective views sequentially showing the assembled state of the actuator AC with different perspective directions. Note that FIGS. 12A and 12B are diagrams showing a state where the moving member 60 corresponds to the retreating posture.

Mainly referring to FIG. 8A to FIG. 9B, the moving member 60 includes the foregoing interference part 61, and a base part 62 integrally connected to the interference part 61. The interference part 61 includes a linearly extending rod-shaped body part 611, and a curved part 612 positioned on the tip side of the body part 611. The body part 611 has a substantially cylindrical shape, and the curved part 612 has a semicircular arc shape that is curved along the document sheet transport direction.

The base part 62 generally has an elongated shape that is long in the sliding direction (front-back direction of the direction indication in FIGS. 8A and 8B) based on a side view, and has a long hole 63 extending along the sliding direction. As a result of including the long hole 63, the base part 62 includes a front plate 621, a top plate 622 (guided part) extending rearward from the upper end of the front plate 621, a bottom plate 623 extending rearward from the lower end of the front plate 621, and a rear plate 624 which connects the rear ends of the top plate 622 and the bottom plate 623. Note that roughly half of the rear of the bottom plate 623 is provided with a notch part 625 that is formed by cutting out a part of its horizontal width for housing the light shielding member 75. The interference part 61 protrudes forward from the upper end of the front plate 621 as the base part. The top plate 622 continues substantially linearly to the rear of the interference part 61.

The long hole 63 includes a broad part 631 positioned at the front side, and a narrow part 632 positioned at the rear side. The broad part 631 is a space that is compartmentalized by a front inner wall 641 of the top plate 622, a front inner wall 642 of the bottom plate 623, and an inner wall of the front plate 621, and is mainly used upon attaching the support member 70 to the moving member 60 (to be described later with reference to FIG. 10 to FIG. 12). The narrow part 632 is a space that is compartmentalized by a rear inner wall 643 of the top plate 622, a rear inner wall 644 of the bottom plate 623, and inner wall of the rear plate 624, and is mainly used for sliding the moving member 60. The front inner wall 641 and the rear inner wall 643 of the top plate 622 are a continuous horizontal inner wall without any unevenness. The front inner wall 642 and the rear inner wall 644 of the bottom plate 623 are both inner walls that are parallel to the front inner wall 641 and the rear inner wall 643 of the top plate 622, and the rear inner wall 644 is positioned one level higher than the front inner wall 642. An arc-shaped inclined face 645 is provided between the front inner wall 642 and the rear inner wall 644. Note that a holding protrusion 65 for holding the front end of the compression coil spring 81 is provided, in a protruding manner, to the front inner wall 641 of the top plate 622.

The support member 70 includes a rod-shaped support body part 71 which extends linearly in the left-right direction, a left turning fulcrum part 721 and a right turning fulcrum part 722 disposed at either end of the support body part 71, a guide part (concave groove) disposed at a position that is slightly left of the center part of the support body part 71, a holding protrusion 74 for holding the rear end of the compression coil spring 81, and a plate-shaped light shielding member 75 provided in a protruding manner from the support body part 71 toward the rear.

The support body part 71 is a cylindrical member, and its central axis becomes the rotating axis of the actuator AC. The guide part 73 is a concave groove that is formed by hollowing a part of the cylindrical part of the support body part 71 in the front-back direction. The portion that is more on the left side than the guide part 73 of the support body part 71 has a completely cylindrical shape. Meanwhile, the portion that is more on the right side than the guide part 73 of the support body part has a D pane 723 which is formed by cutting a part of the peripheral direction in a planar shape. Note that the D pane 723 is a pane for allowing the support body part 71 to be inserted into the broad part 631 of the long hole 63 when the moving member 60 is attached to the support member 70.

The left and right turning fulcrum parts 721, 722 are protrusions for rotatably supporting the support body part 71 about its central axis (rotating axis). Referring to FIG. 3 and FIG. 4, a pair of left and right holding plates 25A, 25B is erected from the top face of the support plate 24 of the inner guide member 23. The gap between the left holding plate 25A and the holding plate 25B is substantially equal to the length of the support body part 71 in the left-right direction. Bearing holes 251A, 251B are respectively provided to the pair of left and right holding plates 25A, 25B. The left turning fulcrum part 721 is rotatably supported by the bearing hole 251A of the left holding plate 25A and the right turning fulcrum part 722 is rotatably supported by the bearing hole 251B of the right holding plate 25B, respectively.

The guide part 73 is fitted into the top plate 622 of the moving member 60, and guides the sliding movement of the moving member 60 in the front-back direction. The width of the guide part 73 in the left-right direction is slightly wider than the width of the top plate 622 in the left-right direction. Moreover, the outer diameter (thickness in the up-down direction) of the support body part 71 in the forming position of the guide part 73 is slightly smaller than the width (gap of the rear inner walls 643, 644) of the narrow part 632 of the long hole 63 in the up-down direction. In the support member 70, only this guide part 73 has a size that can be passed through the narrow part 632. In a state where the guide part 73 is fitted into the narrow part 632, the moving member 60 is unable to relatively turn relative to the support member 70, and the two turn steadily when subject to the rotative force of the support body part 71 about the central axis.

The holding protrusion 74 is provided forward in a protruding manner from the peripheral wall near the portion where the guide part 73 of the support body part 71 is formed. The light shielding member 75 is provided rearward in a protruding manner from the peripheral wall of the support body party 71 at a position facing the holding protrusion 74. The light shielding member 75 is a member that can be housed in the gap G where the light path is formed between the light emitting unit 91 and the light receiving unit 92, and enters the light path and withdraws from the light path based on the rotating angle of the support body part 71 about the central axis. The light shielding member 75 is adjacent to the notch part 625 of the base part 62 in the left-right direction in a state where the moving member 60 and the support member 70 are assembled.

The compression coil spring 81 is housed in the long hole 63, the front end thereof is fitted into the holding protrusion 65 of the moving member 60, and the rear end thereof is fitted into the holding protrusion 74 of the support member 70. The compression coil spring 81 biases the moving member 60 so that the interference part 61 of the moving member 60 takes on the protruding posture of protruding to the document sheet transport path 203.

The torsion coil spring 82 is fitted into the portion having the D pane 723 of the support body part 71 and, upon viewing FIG. 5, applies biasing force to the actuator AC so as to rotate about the central axis of the support body part 71 in the clockwise direction. The torsion coil spring 82 includes a coil part 821, a first coil end part 822 (refer to FIG. 4) which comes into contact with and is stopped by the inner wall (front inner wall 641) of the long hole 63, and a second coil end part 823 which comes into contact with and is stopped by the locking part (not shown) provided to an appropriate location in the housing of the ADF 200. The support body part 71 is inserted through the coil part 821.

The light emitting unit 91 of the detection unit 90 includes a light emitting element such as a light emitting diode (LED) for emitting inspection light of a predetermined wavelength. The light receiving unit 92 includes a light receiving element such as a photo diode (PD) having sensitivity to the light emitted from the light emitting element. A connector unit 93 for connecting a control line and a power supply line to the light emitting unit 91 and the light receiving unit 92 is disposed adjacent to the light emitting unit 91. In this embodiment, the light path between the light emitting unit 91 and the light receiving unit 92 is constantly blocked by the light shielding member 75, and the blocked state of the light path by the light shielding member 75 is released when a document sheet passes through the document sheet transport path 203. In other words, the light receiving unit 92 outputs a light reception signal to the control unit 20 (FIG. 2) upon the passage (retention) of the document sheet.

The operation upon assembling the support member 70 and the moving member 60 is now explained with reference to FIG. 8A to FIG. 12B. Note that this explanation concurrently serves as the explanation of the sliding operation of the moving member 60 (sliding upon changing the posture between the protruding posture and the retreating posture).

The state shown in FIGS. 9A and 9B is the state immediately before the assembly of the moving member 60 and the support member 70. Foremost, the support member 70 is disposed on the left side of the long hole 63 of the moving member 60. Here, the moving member 60 is disposed so that the interference part 61 faces forward, and the support member 70 is disposed so that the D pane 723 of the support body part 71 faces rightward. In addition, as shown with the arrow A1 in FIG. 9A, the support member 70 is inserted into the broad part 631 of the long hole 63 of the moving member 60 from the side of the right turning fulcrum part 722 of the support body part 71. The outer diameter (thickness in the up-down direction) at the position of forming the D pane 723 is slightly smaller than the width (gap of the front inner walls 641, 642) of the broad part 631 of the long hole 63 in the up-down direction. Thus, the insertion of the support member 70 is thereby permitted.

Figure 10A:
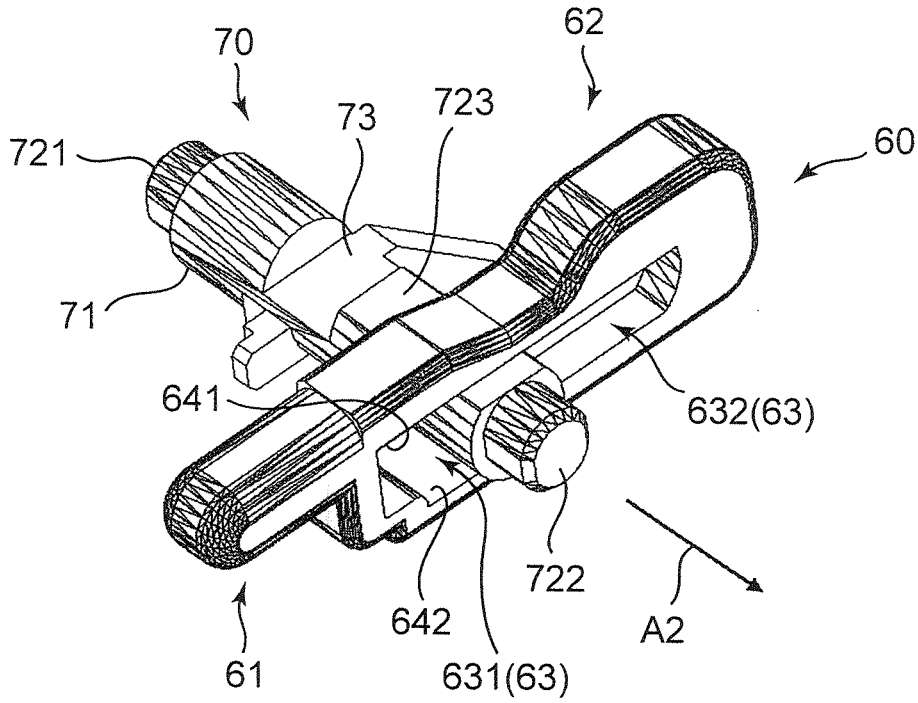
FIGS. 10A and 10B are perspective views showing the assembled state of the actuator.
Figure 10B:
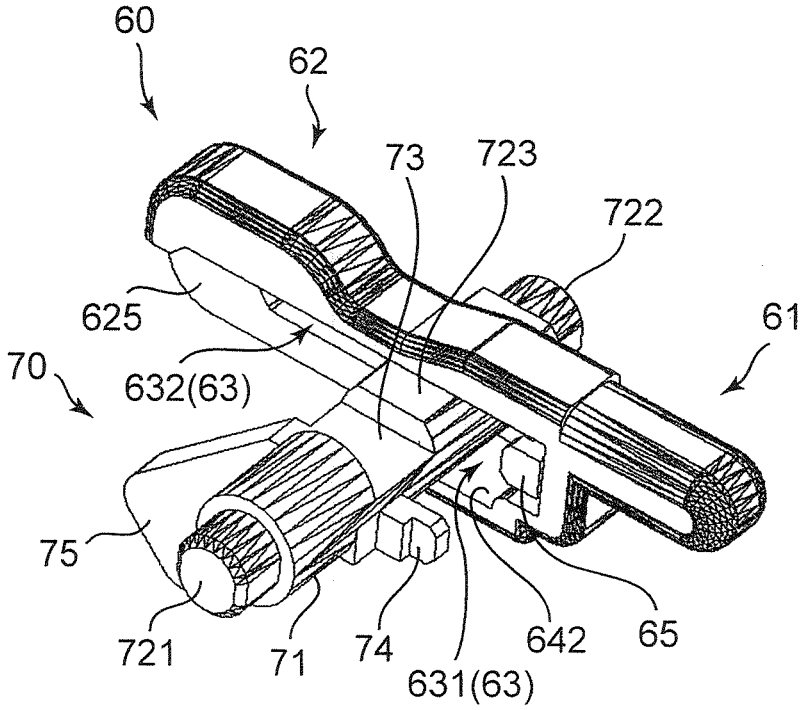

FIGS. 10A and 10B show a state where the insertion of the support member 70 into the moving member 60 has progressed to a certain extent. Here, the D pane 723 of the support member 70 slidably contacts the front inner wall 641 of the moving member 60, and the peripheral surface of the support body part 71 on the rear face side of the D pane 723 slidably contacts the front inner wall 642 and the inclined face 645. From this state, the insertion of the support member 70 is further continued in a direction shown with the arrow A2 in FIG. 10A.

Figure 11A:
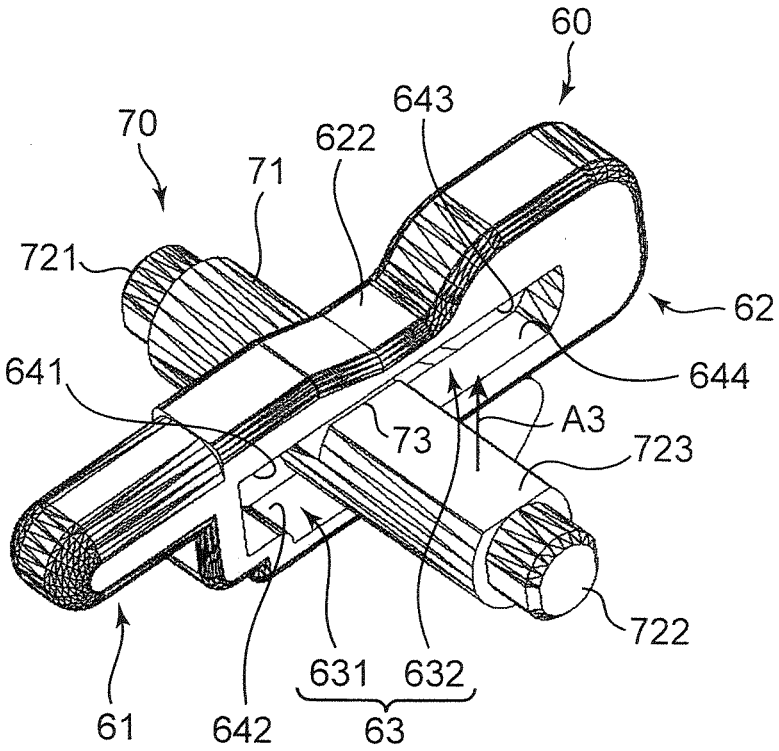
FIGS. 11A and 11B are perspective views showing the assembled state of the actuator.
Figure 11B:
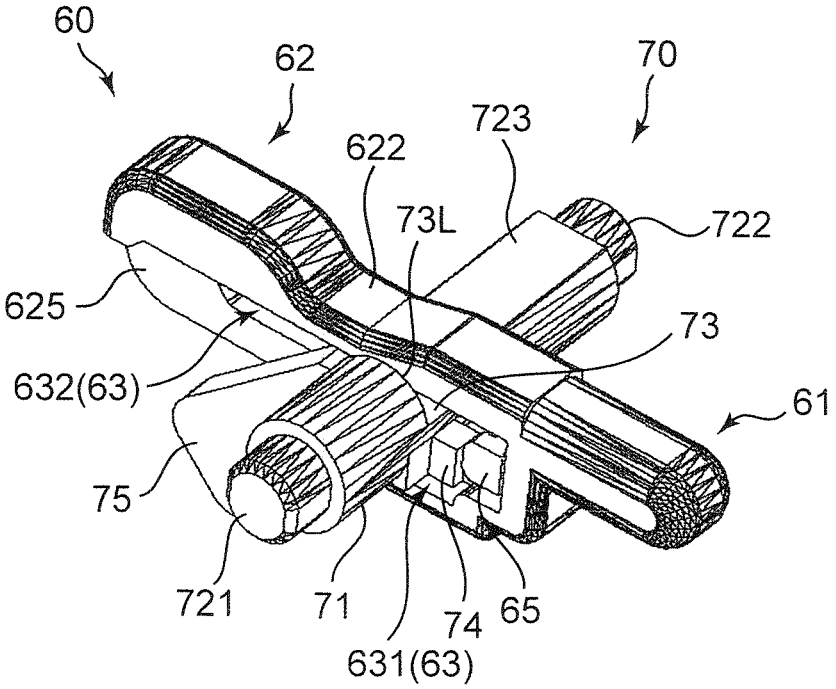
Figure 12A:
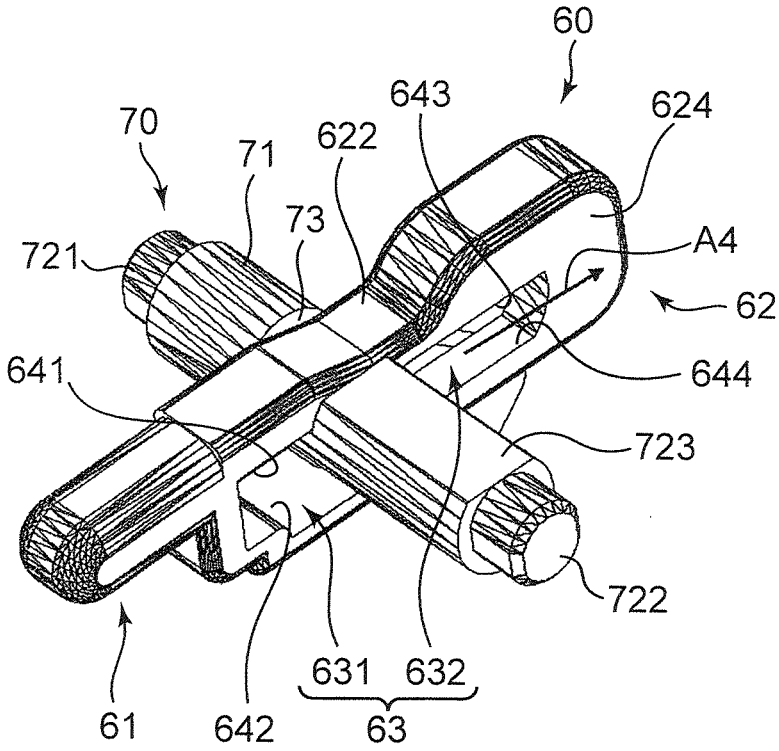
FIGS. 12A and 12B are perspective views showing the actuator, and show a state where the moving member corresponds to a retreating posture.
Figure 12B:
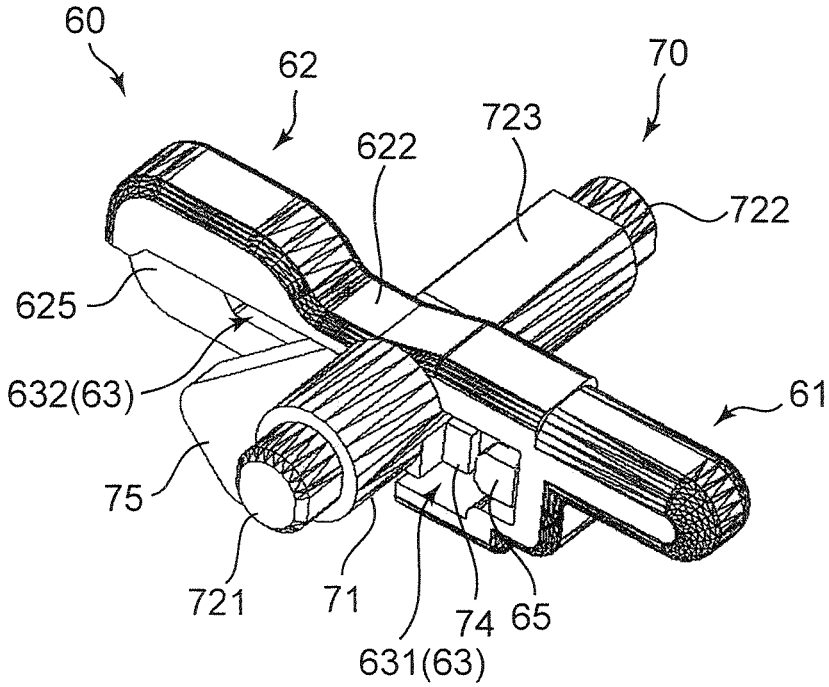

FIGS. 11A and 11B shows a state where the support member 70 has been inserted into the moving member 60 up to a state where the D pane 723 of the support member 70 passed through the long hole 63, and the guide part 73 is positioned immediately below the top plate 622 of the base part 62. As shown in FIG. 11B, in this state, the left groove wall 73L of the guide part 73 comes into contact with and is stopped by the left side wall of the top plate 622. In other words, the portion that is more on the left side than the guide part 73 of the support body part 71 is unable to pass through the broad part 631 of the long hole 63. As a result of the left groove wall 73L coming into contact with and being stopped by the top plate 622 as described above, the positioning of the guide part 73 and the top plate 622 is carried out, and the light shielding member 75 becomes housed in the notch part 625 of the bottom plate 623. From this state, the support member 70 is moved upward as shown with the arrow A3 in FIG. 11A.

FIGS. 12A and 12B show a state where the upward movement of the support member 70 is complete. The guide part 73 is fitted into the top plate 622. Moreover, as shown in FIG. 12B, the holding protrusion 65 of the moving member 60 and the holding protrusion 74 of the support member 70 for holding the compression coil spring 81 become adjacent and face each other. A state where the moving member 60 moves relatively more rearward relative to the support member 70 and the guide part 73 is inserted further into the inlet part of the narrow part 632 than the state shown in FIGS. 12A and 12B becomes a posture of the moving member 60 which corresponds to the retreating posture.

As shown with the arrow A4 in FIG. 12A, when the support member 70 is moved rearward toward the rear plate 624; that is, when the moving member 60 is slid forward, the state shown in FIG. 8A is realized. This state is a state which corresponds to the protruding posture of the moving member 60. The state shown in FIG. 8A to FIG. 12A, and contrarily the sliding of the moving member 60 to the state shown from FIG. 12A to FIG. 8A, is achieved by the guide part 73 guiding the top plate 622. Upon the foregoing sliding, the bottom part of the guide part 73 and the rear inner wall 643 of the narrow part 632 of the long hole 63 slidably contact each other, and the peripheral surface of the support body part 71 on the rear face side of the guide part 73 slidably contacts the rear inner wall 644. Meanwhile, the groove walls erected at both the left and right side ends of the bottom part of the guide part 73 respectively slidably contact the left and right side walls of the top plate 622.

In this embodiment, since the moving member 60 and the support member 70 are assembled as described above, it is possible to stably slide the moving member 60 along the guide part 73. Moreover, upon performing the foregoing assembly, it is possible to use the broad part 631 of the long hole 63, and use the narrow part 632 after the assembly, to prevent both members from falling out.

Mainly referring to FIG. 5 to FIG. 7, the operation of the sheet detection device S is now explained. FIG. 5 is a cross section of the sheet detection device S, and shows a state where the actuator AC is in a home position, and the moving member 60 is of a protruding posture. The moving member 60 is in a state of integrally turning together with the support member 70 about the central axis of the support body part 71, and, in this case, biased to turn in the clockwise direction by the torsion coil spring 82.

When the actuator AC is in the home position, the interference part 61 of the moving member 60 protrudes in a manner of cutting across the document sheet transport path 203 through the inner slit 234 of the inner guide member 23. In other words, the body part 611 of the interference part 61 extends toward the document sheet transport path 203 in a direction that is substantially orthogonal to the sheet transportation direction, and the curved part 612 becomes housed in the outer slit 262 (protruding posture). The protruding posture is formed by the biasing force of the compression coil spring 81 working between the holding protrusions 65, 74, and the moving member 60 relatively sliding, by being pushed forward, relative to the support member 70 which will not slide as a result of being retained by the holding plates 25A, 25B.

The interference part 61 is pressed against the upper end wall 235 (restricting part) in the U-shaped notched walls which compartmentalize the inner slit 234 of the inner guide member 23, and the upper end wall 263 (restricting part) in the notched walls which compartmentalize the outer slit 262 of the outer guide member 26 based on the biasing force of the torsion coil spring 82, and its rotation in the clockwise direction is thereby restricted. In other words, the upper end walls 235, 263 function as the restricting parts which define the reference position of the support body part 71 of the moving member 60 in the rotating direction about the central axis. The torsion coil spring 82 biases the moving member 60 (interference part 61) toward the upper end walls 235, 263 and immobilizes the moving member 60. When outer force in the counterclockwise direction which overcomes the biasing force of the torsion coil spring 82 is applied to the interference part 61, the moving member 60 turns in the counterclockwise direction.

The arrow C0 of FIG. 5 shows the advancing direction of the sheet that is being transported on the document sheet transport path 203 in a forward direction. The reference position is defined so that the linearly extending rod-shaped body part 611 is positioned to be inclined by a predetermined angle θ in the counterclockwise direction (turning direction that the moving member 60 is separated from the reference position; first direction) relative to a virtual line L that is orthogonal to the advancing direction C0. According to this configuration, when the actuator AC is at the home position, the body part 611 of the moving member 60 will be inclined by a predetermined angle θ in the counterclockwise direction in advance. Since the document sheet that is transported in the forward direction will collide with the body part 611 that is inclined as described above, advancement in the forward direction will not be obstructed by the moving member 60. Moreover, it is possible to prevent the force against the biasing force of the compression coil spring 81 from working on the moving member 60 from the document sheet that is being transported in the forward direction, and thus the sheet detection operation is not affected. Note that the angle θ is desirably selected within a range of 10 degrees to 40 degrees.

FIG. 6 is a cross section of the sheet detection device S, and shows a state where the actuator AC detected the document sheet SH that is being transported in the forward direction C1. When the document sheet SH is transported on the document sheet transport path 203 in the forward direction C1 by the transport roller 204 (FIG. 1) of the ADF 200, the tip of the document sheet SH in the transport direction will collide with the interference part 61 (body part 611), and thrust in the counterclockwise direction is applied to the interference part 61. The biasing force of the torsion coil spring 82 is set to be weaker than the foregoing thrust. Thus, the moving member 60 (actuator AC) rotates in the counterclockwise direction about the central axis of the support body part 71 against the biasing force of the torsion coil spring 82.

The moving member 60 turns in the counterclockwise direction until it comes into contact with the contact part 236 provided to the inner guide member 23. FIG. 6 shows a state where the base part 62 of the moving member 60 is in contact with the contact part 236. In this state, a gap is formed between the curved part 612 of the interference part 61 and the outer guide face 261, and advancement of the document sheet SH in the forward direction C1 is not obstructed by the interference part 61. Note that the moving member 60 is maintaining the protruding posture. Based on the turning of the actuator AC, the light shielding member 75 is lifted upward, and retreats from the light path between the light emitting unit 91 and the light receiving unit 92. Accordingly, the light receiving unit 92 outputs a light reception signal to the control unit 20, and the passing of the document sheet SH is thereby detected.

Figure 13:
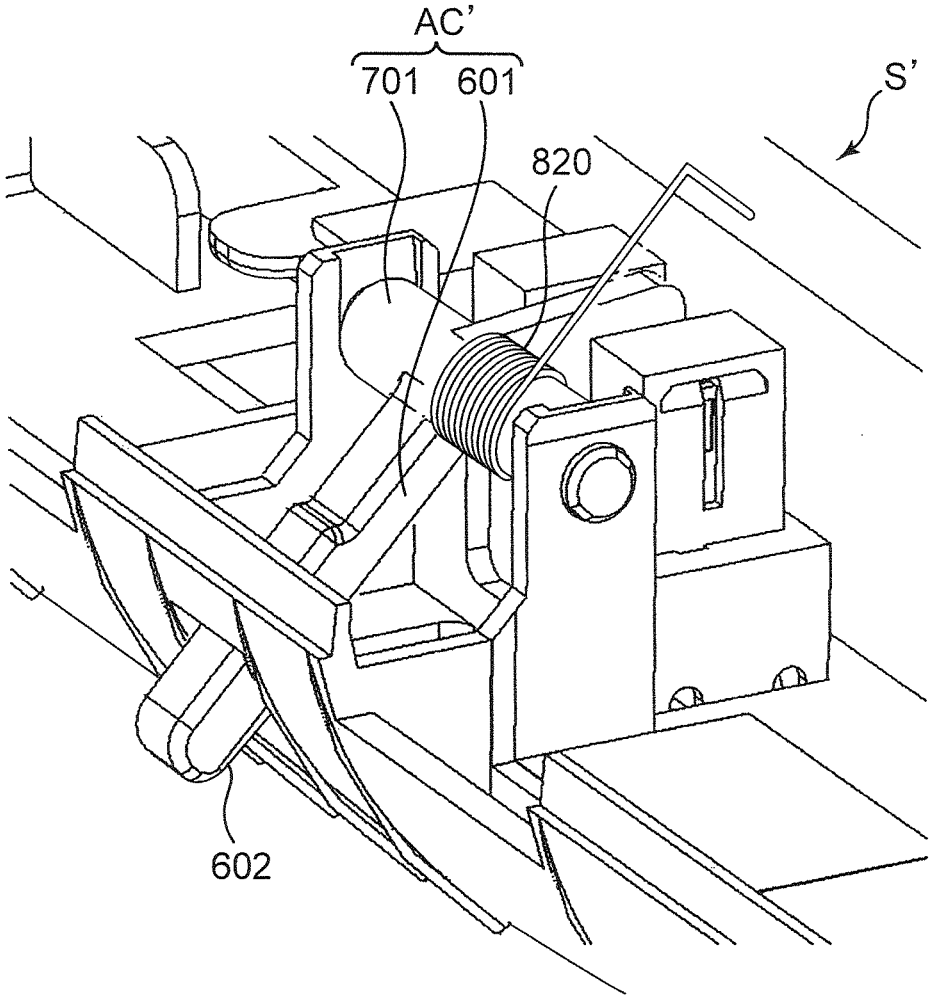
FIG. 13 is a perspective view of the sheet detection device according to a comparative example.

As described above, in the detection of the document sheet SH advancing on the document sheet transport path 203 in the forward direction C1, the moving member 60 maintains the protruding posture and does not slide. Thus, the actuator AC of this embodiment performs substantially the same operation as a conventional actuator AC' in which an oscillation member 601 corresponding to the moving member 60 and the support member 701 shown in FIG. 13 are integrally structured. Meanwhile, when the document sheet SH advances on the document sheet transport path 203 in the reverse direction C2, the actuator AC of this embodiment performs operations that are different from the conventional actuator AC'.

FIG. 7 is a cross section of the sheet detection device S, and shows a state where the document sheet SH is being pulled out in the reverse direction C2. When a sheet jam occurs in the document sheet transport path 203, this means that the state shown in FIG. 6 is continuing, and the light receiving unit 92 continues to output a light reception signal to the control unit 20. The jam determination unit 22 of the control unit 20 detects this state and notifies the occurrence of a sheet jam to the user. In the foregoing case, the user will open the upper cover 200H of the ADF 200 and pull out the jammed document sheet SH in the reverse direction C2.

During this pull-out, the actuator AC turns in the clockwise direction so that the moving member 60, which was separated from the reference position, will return to the reference position. In other words, the moving force of the document sheet SH in the reverse direction C2 works on the curved part 612 of the interference part 61, and causes the moving member 60 to turn in the clockwise direction. At the same time, thrust for pressing the moving member 60 in a direction of entering the document sheet transport path 203 is also applied from the document sheet SH to the curved part 612. Consequently, the moving member 60 slides to the arrow C3 direction against the biasing force of the compression coil spring 81, and changes the posture from the protruding posture to the retreating posture.

As described above, since the posture is changed to the retreating posture in a state where the moving member 60 is returned to the reference position, a gap is formed between the curved part 612 of the interference part 61 and the outer guide face 261, and advancement of the document sheet SH in the reverse direction C2 will not be obstructed by the interference part 61. Accordingly, the user can smoothly remove the jammed document sheet SH without being obstructed by the actuator AC. Here, the interference part 61 comes into contact only with the upper end wall 235 of the inner guide member 23, and the turning of the actuator AC in the clockwise direction is restricted.

In this embodiment, the document sheet transport path 203 includes a transport path that is curved in a U-shape in a cross section view, and the moving member 60 is disposed to extend in the radial direction of the curved transport path. Thus, when the document sheet SH is pulled out in the reverse direction C2, the force of causing the moving member 60 to retreat in the radial direction will naturally work on the curved part 612. In other words, the force of sliding to the retreating posture can more easily work on the moving member 60 from the document sheet SH. Thus, according to this embodiment, it is possible to reduce the resistance upon pulling out the document sheet SH, and thereby realize an even smoother pull-out of the document sheet SH. Note that, when the document sheet SH is completely pulled out, the thrust is released and the moving member 60 returns to the protruding posture shown in FIG. 5 at the reference position.

Figure 14:
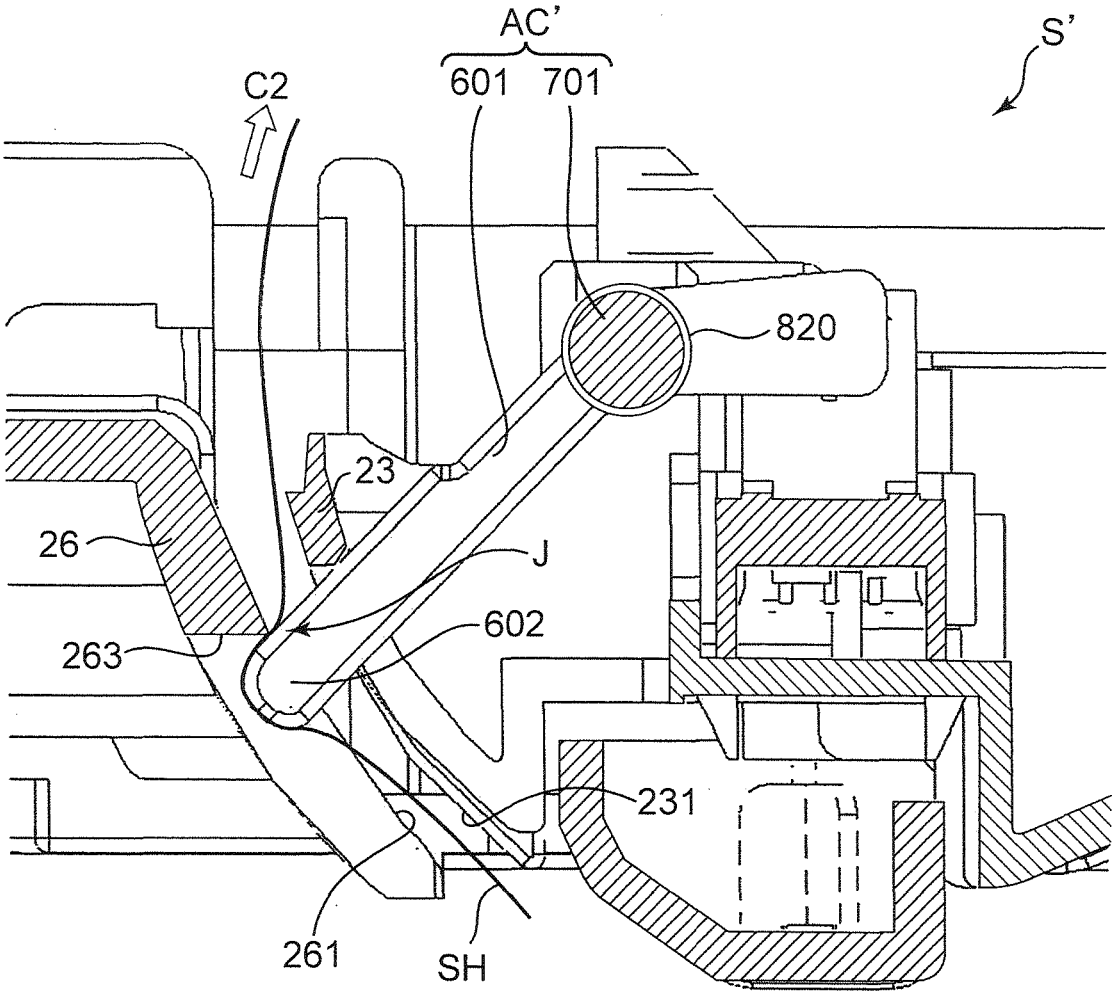
FIG. 14 is a cross section of the sheet detection device according to a comparative example.

FIG. 13 is a perspective view of the sheet detection device S' according to a comparative example, and FIG. 14 is a cross section of the sheet detection device S'. The sheet detection device S' includes an actuator AC' including an oscillation member 601 having an interference part 602 at the tip thereof, and a support member 701 in which the base end part of the oscillation member 601 is integrally coupled and rotatably supported. The actuator AC' is biased in the clockwise direction by the torsion coil spring 820.

Let it be assumed that a sheet jam occurred on the document sheet transport path 203 to which the foregoing sheet detection device S' was applied, and the document sheet SH is to be pulled out in the reverse direction C2. In the foregoing case, the oscillation member 601 remains in a state of protruding to the document sheet transport path 203. Thus, the document sheet SH becomes sandwiched in a contact part J where the interference part 602 and the upper end wall 263 of the outer guide member 26 come into contact as shown in FIG. 14. Accordingly, the user is unable to smoothly remove the jammed document sheet SH as a result of the actuator AC' getting in the way.

Meanwhile, with the sheet detection device S of this embodiment, since the moving member 60 can slide relative to the support member 70, the foregoing drawback will not occur. In other words, the moving member 60 turns in the counterclockwise direction along the forward direction of the sheet transport in a state of maintaining the protruding posture when the document sheet SH passes through the document sheet transport path 203 in the forward direction C1. Accordingly, it is possible to cause the detection unit 90 to perform the detection of the document sheet SH based on the rotation of the actuator AC. Meanwhile, when the document sheet SH once stopped on the document sheet transport path 203 is pulled out in the reverse direction C2 with a predetermined pull-out force, the moving member 60 turns in the clockwise direction and slides in the radial direction of the curved transport path against the biasing force of the compression coil spring 81, and changes the posture from the protruding posture to the retreating posture. Thus, the pull-out of the document sheet SH from the document sheet transport path 203 will not be obstructed by the actuator AC.

Moreover, the reference position of the moving member 60 is defined by the interference part 61 coming into contact with and being stopped by the upper end walls 235, 263 that function as a restricting part. The moving member 60 turns in a counterclockwise direction from the reference position during the transport of the document sheet SH in the forward direction (FIG. 6), returns to the reference position from the state of turning in the counterclockwise direction, and additionally slides when subject to the pull-out force of the document sheet SH in the course of returning to the reference position. As a result of defining the reference position as described above, the operation of the moving member 60 can be regularized, and the moving member 60 can be moves stably.

An embodiment of the present disclosure was explained in detail above, but the present disclosure is not limited thereto. The present disclosure may also, for example, take on the following modified embodiments.

(1) In the foregoing embodiment, explained was a case where the interference part 61 includes a rod-shaped body part 611, and a curved part 612 formed at the tip of the body part 611. The interference part 61 may be of any form as long as it can interfere with the sheet that passes through the sheet transport path. However, the tip portion of the interference part 61 is desirably of a form that will not apply friction to the sheet. For example, a roller which rotates by following the passage of the sheet may be provided to the tip of the interference part 61.

(2) In the foregoing embodiment, explained was a case of assembling the moving member 60 and the support member 70 in a manner of inserting the support member 70 through the long hole 63 of the moving member 60. This mode is merely an example, and various sliding structures may be applied. For example, the configuration may include a support member including a cylinder part protruding in a direction that is orthogonal to the rotating axis direction, and a moving member which is assembled to the cylinder part and can move back and forth.

(3) In the foregoing embodiment, the detection unit 90 was illustrated as a photo interrupter-type detection unit. This is merely an example, and there is no particular limitation to the detection unit as long as it can detect the sheet based on the rotation of the moving member 60 or the support member 70. For example, the detection unit may be of a form where a pressure piece provided integrally with the support member 70 presses a mechanical electric contact based on the turning of the support member 70.

(4) In the foregoing embodiment, a case was explained where the sheet detection device S is applied to a curved sheet transport path. Needless to say, the sheet detection device according to the present disclosure can also be applied to a linearly extending sheet transport path. Moreover, while a case of applying the sheet detection device S to the document sheet transport path 203 of the ADF 200 was explained, the sheet detection device S may also be applied to the first and second sheet transport paths 404, 405, which are the transport paths of the printing sheets in the body housing 10.

(5) In the foregoing embodiment, a case was explained where the sheet detection device is applied to a copying machine 1 (ADF 200) as the image forming apparatus. The sheet detection device according to the present disclosure can also be applied to apparatuses other than an image forming apparatus which include a transport path of various sheets such as paper, resin film, metal sheet and the like.

As described above, according to the present disclosure, it is possible to provide a sheet detection device which will not obstruct the pull-out of the sheet from the sheet transport path without having to increase the number of components, and an automatic document feeder and an image forming apparatus to which the foregoing sheet detection device is applied.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet detection device for detecting a sheet that passes through a sheet transport path, comprising:

a moving member including an interference part capable of interfering with the sheet that passes through the sheet transport path;

a support member slidably supporting the moving member in a manner that allows a change in a posture of the moving member between a protruding posture in which the interference part protrudes to the sheet transport path and a retreating posture in which the interference part retreats from the sheet transport path relative to the protruding posture, and the support member defining a rotating axis extending in a direction that is orthogonal to the sliding direction, and the support member rotates about the rotating axis to thereby cause the moving member to rotate about the rotating axis;

a first bias member that biases the moving member so that the moving member takes the protruding posture; and a detection unit that performs a detection operation of the sheet based on the rotation of the moving member, wherein when the sheet passes through the sheet transport path in a forward direction, the sheet interferes with the interference part of the moving member in the protruding posture, and the sheet turns the moving member in a first direction along the forward direction in a state of maintaining the protruding posture, and when the sheet, once stopped on the sheet transport path, is pulled out in a reverse direction, the sheet interferes with the interference part of the moving member in the protruding posture, and the sheet causes the moving member to turn in a second direction that is opposite to the first direction as the sheet is pulled out in the reverse direction, and the sheet changes the posture of the moving member from the protruding posture to the retreating posture against a biasing force of the first bias member as the sheet is pulled out in the reverse direction.

2. The sheet detection device according to claim 1, further comprising:

a restricting part which defines a reference position of the moving member in a rotating direction about the rotating axis; and a second bias member which biases the moving member toward the restricting part, wherein the first direction is a turning direction in which the moving member becomes separated from the reference position, and when the sheet passes through the sheet transport path in the forward direction, the moving member turns in the first direction against a biasing force of the second bias member, and the second direction is a turning direction in which the moving member that is separated from the reference position returns to the reference position, and when the sheet is pulled out in the reverse direction, the moving member turns in the second direction and returns to the reference position, and changes the posture to the retreating posture against the biasing force of the first bias member.

3. The sheet detection device according to claim 2, wherein the interference part includes a rod-shaped body part which extends linearly, and the reference position is defined such that the rod-shaped body part is positioned to be inclined by a predetermined angle in the first direction relative to a virtual line that is orthogonal to an advancing direction of the sheet to be transported through the sheet transport path in the forward direction.

4. The sheet detection device according to claim 3, wherein the sheet transport path is a curved transport path, and the moving member is disposed to extend in a radial direction of the curved transport path.

5. The sheet detection device according to claim 1, wherein the support member includes a rod-shaped support body part which extends linearly, a turning fulcrum part disposed on either end of the rod-shaped support body part, and a guide part disposed between the turning fulcrum parts, and the moving member includes a base part which is connected to the interference part, and slides by being guided by the guide part.

6. The sheet detection device according to claim 5, wherein the guide part of the support member is a concave groove formed by hollowing a part of the support body part, the base part has a long hole extending along the sliding direction, and the long hole includes a broad part which allows the support body part to pass therethrough and a narrow part which allows only the concave groove to pass therethrough, and the interference part is connected to the base part.

7. The sheet detection device according to claim 6, wherein the first bias member is a compression coil spring disposed between a peripheral face of the support body part and an inner wall face of the long hole, and the second bias member is a torsion coil spring including a coil part, and the support body part is inserted through the coil part.

8. The sheet detection device according to claim 1, wherein the detection unit includes a light emitting unit and a light receiving unit disposed with a gap therebetween, and a light shielding member capable of entering and withdrawing from a light path between the light emitting unit and the light receiving unit, and the light shielding member is integrally mounted to the support member, and enters the light path or withdraws from the light path based on a rotating angle of the support member about the axis.

9. Automatic document feeder, comprising:

a document sheet transport path for transporting a document sheet via an optical reading position; and a sheet detection device disposed with respect to the document sheet transport path and to detects the document sheet that passes through the document sheet transport path; wherein the sheet detection device includes:

a moving member including an interference part capable of interfering with the document sheet that passes through the document sheet transport path;

a support member slidably supporting the moving member in a manner that allows a change in a posture of the moving member between a protruding posture in which the interference part protrudes to the document sheet transport path and a retreating posture in which the interference part retreats from the document sheet transport path relative to the protruding posture, and the support member defining a rotating axis extending in a direction that is orthogonal to the sliding direction, and the support member rotates about the rotating axis to thereby cause the moving member to rotate about the rotating axis;

a first bias member that biases the moving member so that the moving member takes the protruding posture; and a detection unit that performs a detection operation of the document sheet based on the rotation of the moving member, wherein when the document sheet passes through the document sheet transport path in a forward direction, the document sheet interferes with the interference part of the moving member in the protruding posture, and the document sheet turns the moving member in a first direction along the forward direction in a state of maintaining the protruding posture, and when the document sheet, once stopped on the document sheet transport path, is pulled out in a reverse direction, the document sheet interferes with the interference part of the moving member in the protruding posture, and the document sheet causes the moving member to turn in a second direction that is opposite to the first direction as the document sheet is pulled out in the reverse direction, and the document sheet changes the posture from the protruding posture to the retreating posture against a biasing force of the first bias member as the document sheet is pulled out in the reverse direction.

10. The automatic document feeder according to claim 9, further comprising:

a restricting part which defines a reference position of the moving member in a rotating direction about the rotating axis; and a second bias member which biases the moving member toward the restricting part, wherein the first direction is a turning direction in which the moving member becomes separated from the reference position, and when the document sheet passes through the document sheet transport path in the forward direction, the moving member turns in the first direction against a biasing force of the second bias member, and the second direction is a turning direction in which the moving member that is separated from the reference position returns to the reference position, and when the document sheet is pulled out in the reverse direction, the moving member turns in the second direction and returns to the reference position, and changes the posture to the retreating posture against the biasing force of the first bias member.

11. The automatic document feeder according to claim 10, wherein the interference part includes a rod-shaped body part which extends linearly, and the reference position is defined such that the body part is positioned to be inclined by a predetermined angle in the first direction relative to a virtual line that is orthogonal to an advancing direction of the document sheet to be transported through the document sheet transport path in the forward direction.

12. The automatic document feeder according to claim 11, wherein the document sheet transport path is a curved transport path, and the moving member is disposed to extend in a radial direction of the curved transport path.

13. The automatic document feeder according to claim 9, wherein the support member includes a rod-shaped support body part which extends linearly, a turning fulcrum part disposed on either end of the support body part, and a guide part disposed between the turning fulcrum parts, and the moving member includes a base part which is connected to the interference part, and slides by being guided by the guide part.

14. The automatic document feeder according to claim 13, wherein the guide part of the support member is a concave groove formed by hollowing a part of the support body part, the base part has a long hole extending along the sliding direction, and the long hole includes a broad part which allows the support body part to pass therethrough and a narrow part which allows only the concave groove to pass therethrough, and the interference part is connected to the base part.

15. The automatic document feeder according to claim 14, wherein the first bias member is a compression coil spring disposed between a peripheral face of the support body part and an inner wall face of the long hole, and the second bias member is a torsion coil spring including a coil part, and the support body part is inserted through the coil part.

16. The automatic document feeder according to claim 9, wherein the detection unit includes a light emitting unit and a light receiving unit disposed with a gap therebetween, and a light shielding member capable of entering and withdrawing from a light path between the light emitting unit and the light receiving unit, and the light shielding member is integrally mounted to the support member, and enters the light path or withdraws from the light path based on a rotating angle of the support member about the axis.

17. An image forming apparatus, comprising:

an image forming unit which performs image forming processing to a printing sheet;

a printing sheet transport path for transporting the printing sheet via the image forming unit; and a sheet detection device which is disposed with respect to the printing sheet transport path and which detects the printing sheet that passes through the printing sheet transport path, wherein the sheet detection device includes:

a moving member including an interference part capable of interfering with the sheet that passes through the sheet transport path;

a support member slidably supporting the moving member in a manner that allows a change in a posture of the moving member between a protruding posture in which the interference part protrudes to the sheet transport path and a retreating posture in which the interference part retreats from the sheet transport path relative to the protruding posture, and the support member rotates about a rotating axis extending in a direction that is orthogonal to the sliding direction to thereby cause the moving member also to rotate about the rotating axis;

a first bias member that biases the moving member so that the moving member takes the protruding posture; and a detection unit that performs a detection operation of the sheet based on the rotation of the moving member and the support member, wherein when the sheet passes through the sheet transport path in a forward direction, the sheet interferes with the interference part of the moving member in the protruding posture, and the sheet turns the moving member in a first direction along the forward direction in a state of maintaining the protruding posture, and when the sheet, once stopped on the sheet transport path, is pulled out in a reverse direction with a predetermined pull-out force, the sheet causes the moving member to turns in a second direction that is opposite to the first direction as the sheet is pulled out in the reverse direction, and the sheet changes the posture of the moving member from the protruding posture to the retreating posture against a biasing force of the first bias member as the sheet is pulled out in the reverse direction.

* * * * *